United States Patent [19]

Tsay

[11] Patent Number: 5,009,559

[45] Date of Patent: Apr. 23, 1991

[54] ELEVATOR TYPE PARKING LOT

[76] Inventor: Chyi J. Tsay, No. 5-1, Tung Ping Lane, Chen Ping Li, Pei Tun Chu, Taichung City, Taiwan

[21] Appl. No.: 428,872

[22] Filed: Oct. 30, 1989

[51] Int. Cl.[5] ..... E04H 6/00

[52] U.S. Cl. ..... 414/259; 414/255; 414/256; 414/253; 414/260

[58] Field of Search ..... 414/227, 231, 232, 234, 414/239, 240, 246, 245, 243, 252, 253, 255, 256, 259, 260, 263, 261, 286, 278

[56] References Cited

U.S. PATENT DOCUMENTS

| | | | |
|---|---|---|---|
| 2,647,647 | 8/1953 | Alimanestiano | 414/254 |
| 2,691,448 | 10/1954 | Lontz | 414/256 X |
| 2,838,186 | 6/1958 | Alimanestiano | 414/254 |
| 2,945,602 | 7/1960 | Kroll et al. | 414/254 |
| 2,945,604 | 7/1960 | Kroll et al. | 414/254 |
| 3,896,955 | 7/1975 | Collins et al. | 414/254 |

FOREIGN PATENT DOCUMENTS

| | | | |
|---|---|---|---|
| 1331341 | 5/1963 | France | 414/259 |
| 86/04107 | 7/1986 | PCT Int'l Appl. | 414/259 |

*Primary Examiner*—Frank E. Werner

*Attorney, Agent, or Firm*—Poms, Smith, Lande & Rose

[57] ABSTRACT

An elevator type parking lot includes a number of layers of frames, one or more layers of holding units being provided along each side of a passage which is provided on a center portion of each layer of the frames, and an elevator slidable vertically to align with each layer of the frame. A sliding conveyer which is vertically extendible is lifted and carried by the elevator. The sliding conveyer is slidable on the elevator and slidable along each passage of each layer of the frame so as to align with each holding unit. A cross slide feed mechanism is provided on the sliding conveyer. A sliding carrier is carried on the sliding conveyer and is raised by the sliding conveyer to align with each holding unit and is actuated to move laterally by the cross slide feed mechanism toward each holding unit.

12 Claims, 22 Drawing Sheets

ELEVATOR TYPE PARKING LOT

BACKGROUND OF THE INVENTION

The present invention relates to a parking lot, and more particularly to an elevator type parking lot.

It has become harder and harder to find a parking place in busy cities, such as Los Angeles, New York, Dallas, Taipei, etc. Especially in Taipei, one often spends more than half an hour to find a parking place even though many parking lots have been developed. One of the most popular parking lots is a ramp type parking lot which provides a helical ramp for the cars to climb up the parking lot building. The helical ramp occupies a relatively large space.

Normally, the down town area is where parking lots are most needed. However, it has become harder and harder to find space down town to build a parking lot.

The present invention has arisen to mitigate and/or obviate the afore-described disadvantages of the conventional parking lots.

SUMMARY OF THE INVENTION

The primary objective of the present invention is to provide an elevator type parking lot which is suitable for being straddled over roads and is suitable for being constructed anywhere in downtown area.

Another objective of the present invention is to provide an elevator type parking lot which occupies a relatively compact space.

According to one embodiment of the present invention, an elevator type parking lot includes a number of layers of frames, one or more layers of holding units being provided along each side of a passage which is provided on a center portion of each layer of the frames, and an elevator slidable vertically to align with each layer of the frame. A sliding conveyer which is vertically extendible is lifted and carried by the elevator. The sliding conveyer is slidable on the elevator and slidable along each passage of each layer of the frame so as to align with each holding unit. A cross slide feed mechanism is provided on the upper frame. A sliding carrier is carried on the sliding conveyer and is raised by the sliding conveyer to align with each holding unit and is actuated to move laterally by the cross slide feed mechanism toward each holding unit.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
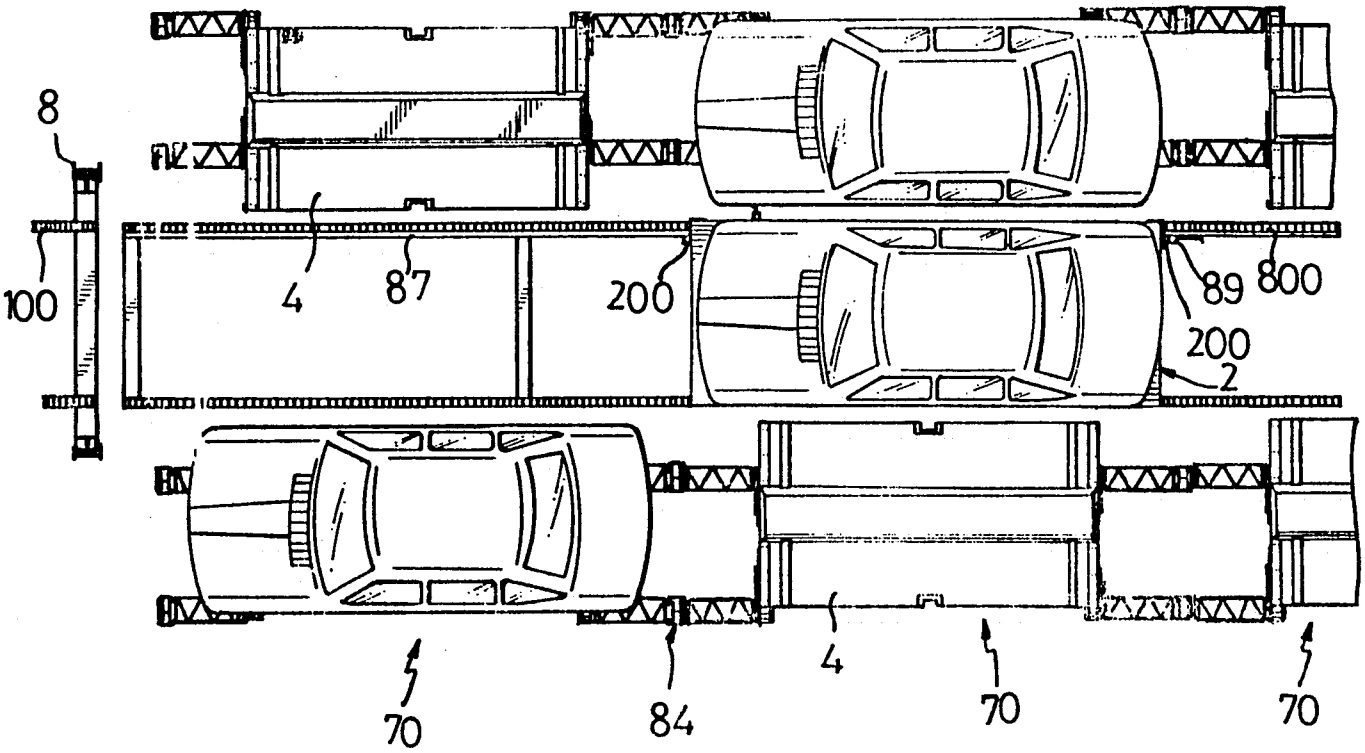
FIG. 1 is a top view of an elevator type parking lot in accordance with the present invention.
Figure 2:
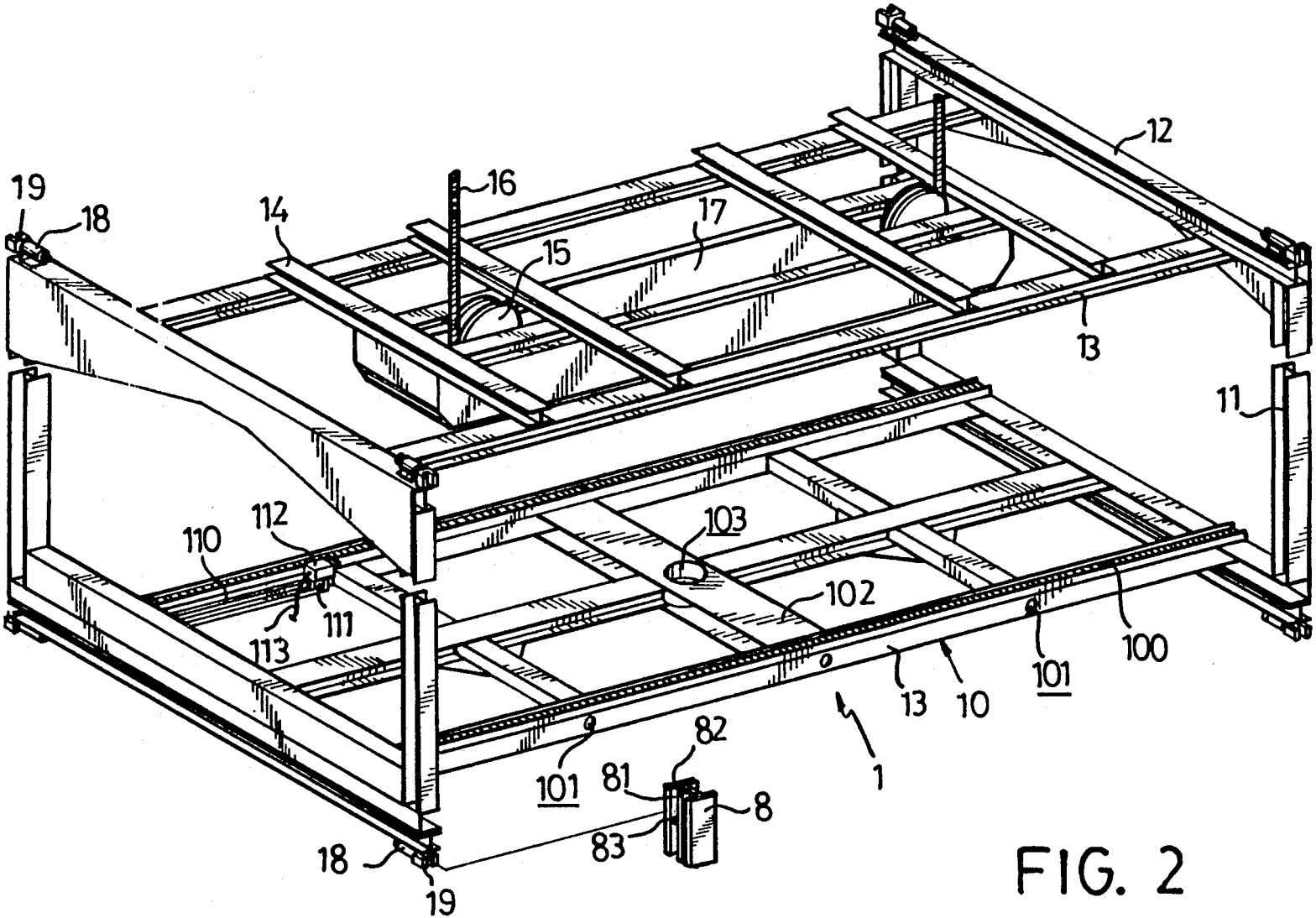
FIG. 2 is a perspective view of an elevator of the elevator type parking lot, in which sections of the vertical posts are cut-off.
Figure 3:
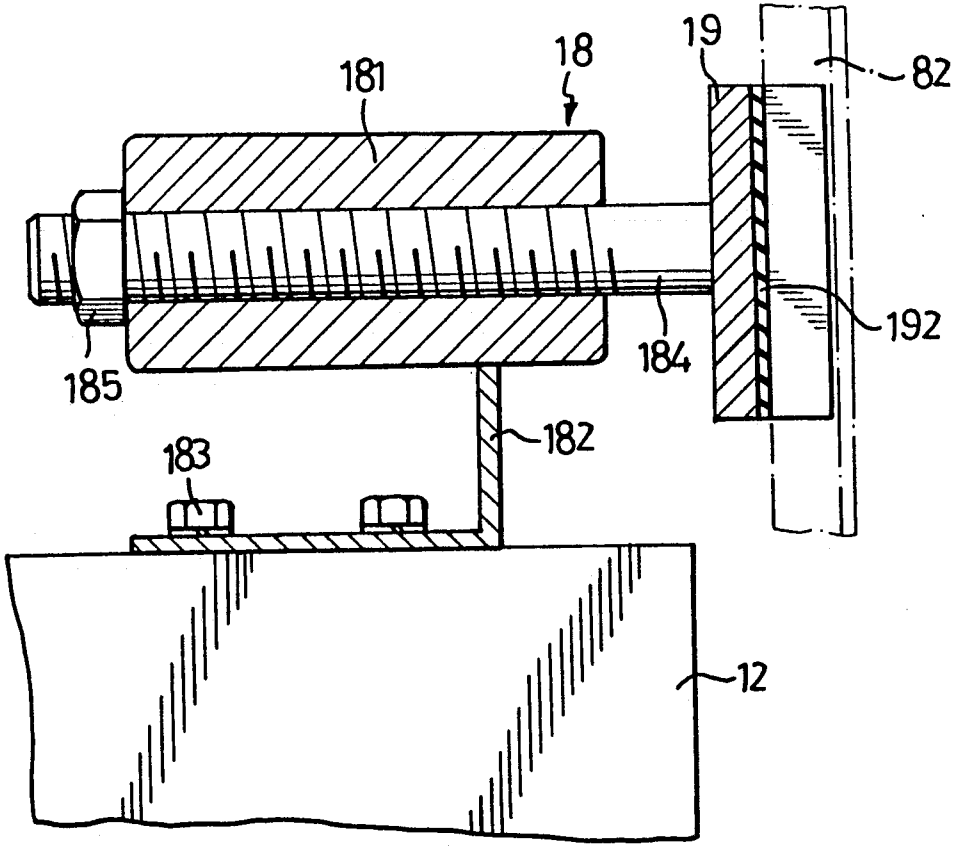
FIG. 3 is a partial cross-sectional view illustrating the engagement between the elevator and the vertical tracks.

Referring to the drawings and initially to FIGS. 1, 2 and 3, the elevator type parking lot in accordance with the present invention comprises generally an elevator 1 slidable vertically along four I-beams 8, a sliding conveyer 2 (FIG. 4) carried by the elevator 1, a number of sliding carriers 4 which are carried by the sliding conveyer 2 for holding motor vehicles and a plurality of layers of main frames 7. As shown in FIG. 1, illustrated is a partial portion of one layer of the main frame 7. A passage 80 with a pair of parallel racks 800 is provided on a middle portion of each layer of the main frame 7 which includes a row of lattice type holding units 70 arranged on each side of the passage 80. As shown in FIG. 1, illustrated are two and half holding units 70 in a row. Each holding unit 70 holds one and only one sliding carrier 4, which will be described in detail hereinafter. The elevator 1 is raised to align with each layer so that the sliding conveyer 2, which is raised by the elevator 1, moves off the elevator 1 and slides along the passage 80.

The elevator 1 is generally a rectangular parallelepiped frame body 10 with four vertical beams 11, four lateral beams 12 and four longitudinal beams 13 rigidly connected together. A number of cross bars 14 are rigidly connected on top of the rectangular frame body 10 for carrying a casing 17. A pulley 15 is pivotally disposed at each end of the casing 17 and a cable 16 slidably engages with the pulleys 15. The cable 16, which is actuated by a motor (not shown), controls the up and down movement of the rectangular frame body 10. A sliding guide 18 is disposed on each end of the lateral beams 12. The sliding guide 18 includes a sleeve nut 181 and a bracket 182 rigidly connected together, the bracket is fixed onto the lateral beams 12 by several bolts 183. A guide head 19 which is substantially U-shaped is rigidly connected to one end of a bolt 184. The bolt 184 is threadedly engaged in the sleeve nut 181 and fixed at a position by a locking nut 185.

The four I-beams 8 are vertically extended on the four corners of the elevator 1. A guide strip 82 is longitudinally formed in the center of a recess 81 of each I-beam 8. The recess 81 with the strip 82 faces and engages the guide head 19 of each sliding guide 18. The sliding guides 18 are adjusted and arranged such that the guide head 19 of each sliding guide 18 snugly fits within the recess 81 of each I-beam 8. Therefore, the elevator 1 is guided to move up and down along the I-beams 8. A lining 192 is further provided in a recess of the guide head 19 for facilitating the sliding between the guide head 19 and the I-beam 8. A number of microswitches or sensors 83 are provided and distributed on one of the beams 8 corresponding to each layer of the main frame 7 so that each microswitch 83 is triggered when an upper sliding guide 18 of the elevator 1 passes each microswitch 83.

The interior of the rectangular frame body 10 is large enough for accommodating a motor vehicle, such as a car or a truck etc. A rack 100 is provided on an upper surface of each lower longitudinal beam 13 at the base of the rectangular frame body 10. The racks 100 are parallel to the parallel racks 800 of the passage 80. Two holes 101 are formed on an outer side of each lower longitudinal beam 13. A number of bars 102 are provided on the base of the rectangular frame body 10 and a hole 103 is formed in a center of a middle bar 102 thereof. A first guide channel 110, which has a substantially C-shaped cross-section, is disposed along an inner surface of one of the longitudinal beams 13. A first socket 112 is fixed on a first sliding seat 111 which is slidable along the first guide channel 110. An extension wire 113, which is connected to a control device, such as a computer (not shown), is connected to the first socket 112. The length of the first guide channel 110 is about one quarter of the length of each longitudinal beam 13.

Figure 4:
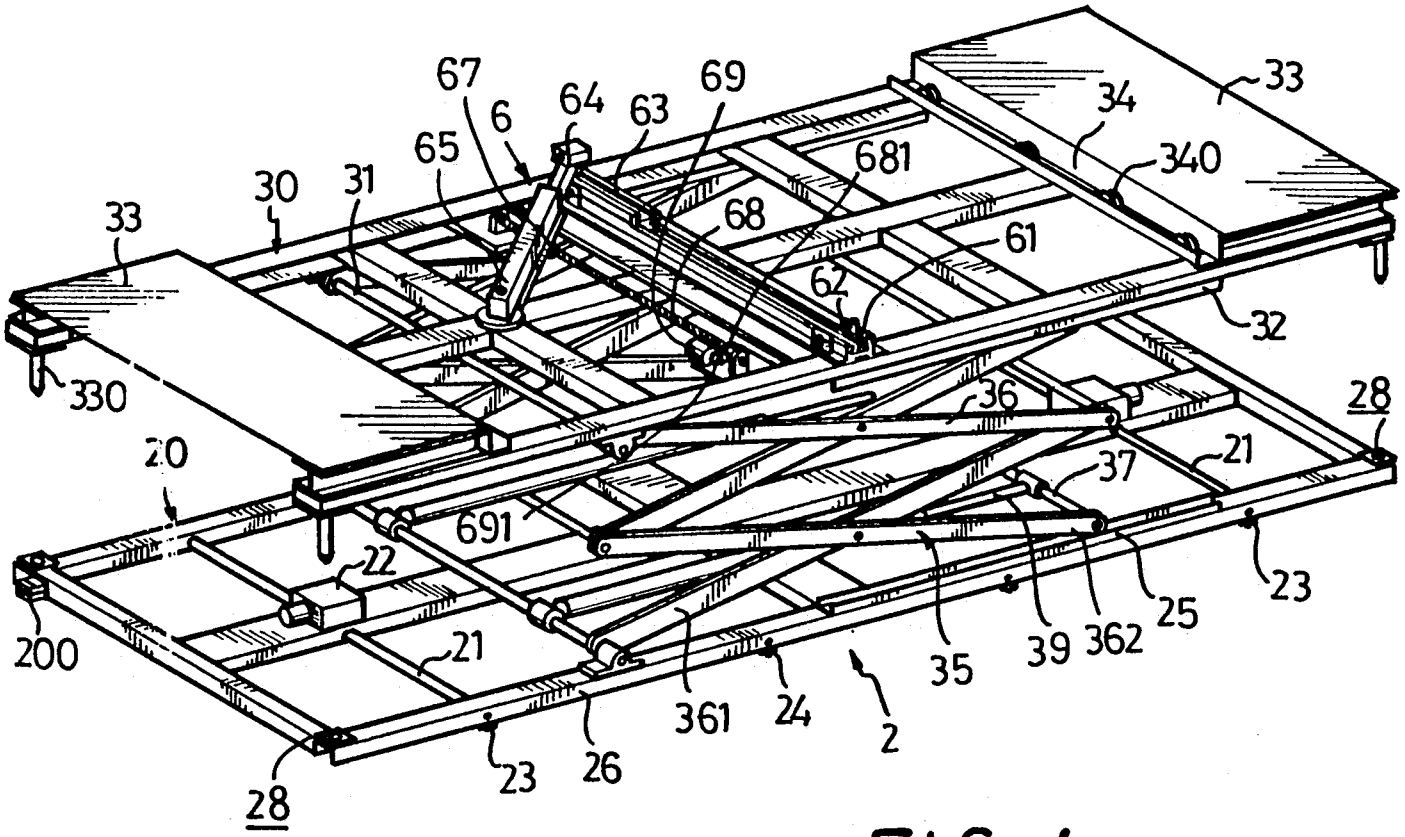
FIG. 4 is a perspective view of a sliding conveyer which is transported by the elevator.

Referring next to FIG. 4, the sliding conveyer 2 comprises generally a lower frame 20 and an upper frame 30 with a lifting mechanism 35 connected therebetween. The lower and the upper frames 20, 30 are substantially rectangular. A rod 21 is axially pivoted at each end of the lower frame 20 and a motor 22 is disposed at a center of each rod 21 for driving the rod 21 to rotate via a gear transmission provided therebetween (not shown). A gear 23 is fixed to each end of the rod 21 and protrudes from a lower surface of each side bar 26 of the lower frame 20. Two gears 24 are further rotatably provided on the lower surface of each side bar 26 of the lower frame 20 so that the gears 23, 24 form two rows of gears in order to engage with the racks 100 of the elevator 1. Therefore, the sliding conveyer 2 is movable along the passage 80 by the motors 22 through the engagement between the gears 23, 24 and the racks 100 and 800. A substantially U-shaped track 25 is provided on each side bar 26 close to one end thereof. The length of each U-shaped track 25 is close to one half of the length of each side bar 26. A first shaft 27 is axially pivoted on the lower frame 20 and separated from the U-shaped track 25. A hole 28 is formed on each corner of the lower frame 20. A plug 200 is disposed on each end of the lower frame 20 corresponding to the first socket 112 of the elevator 1 and to a second socket 89 of each passage 80, which will be described with further details hereinafter.

The lifting mechanism 35 includes a number of bars 36 coupled together in a criss-crossed manner. A lower end of each of two lowest bars 361 on opposite sides of the lower frame 20 is coupled to the first shaft 27. A lower end of each of two other lowest bars 362 on opposite sides of the lower frame 20 is coupled to a second shaft 37 and is slidable along the respective U-shaped tracks 25. A pair of actuators 38, each with a piston rod 39, are connected between the shafts 27 and 37 so that the second shaft 37 is actuated to move toward or away from the first shaft 27, and so that the lifting mechanism 35 is actuated to extend or retract. Similarly, a third shaft 31 is axially pivoted on a lower surface of the upper frame 30 for coupling an upper end of a highest bar. A first track 32 is provided on both sides of the lower surface of the upper frame 30 so that an upper end of an other highest bar slides along the first track 32. A plate 33 is provided on each end of the upper frame 30. Four pairs of rollers 340 are pivotally provided on a second track 34 which is disposed on an inner side of each plate 33. A tapered pin 330 is provided on the lower surface of each corner of the upper frame 30. The tapered pins 330 are engaged with the holes 28 of the lower frame 20 when the upper frame 30 is lowered to the lowest position thereof.

Figure 5:
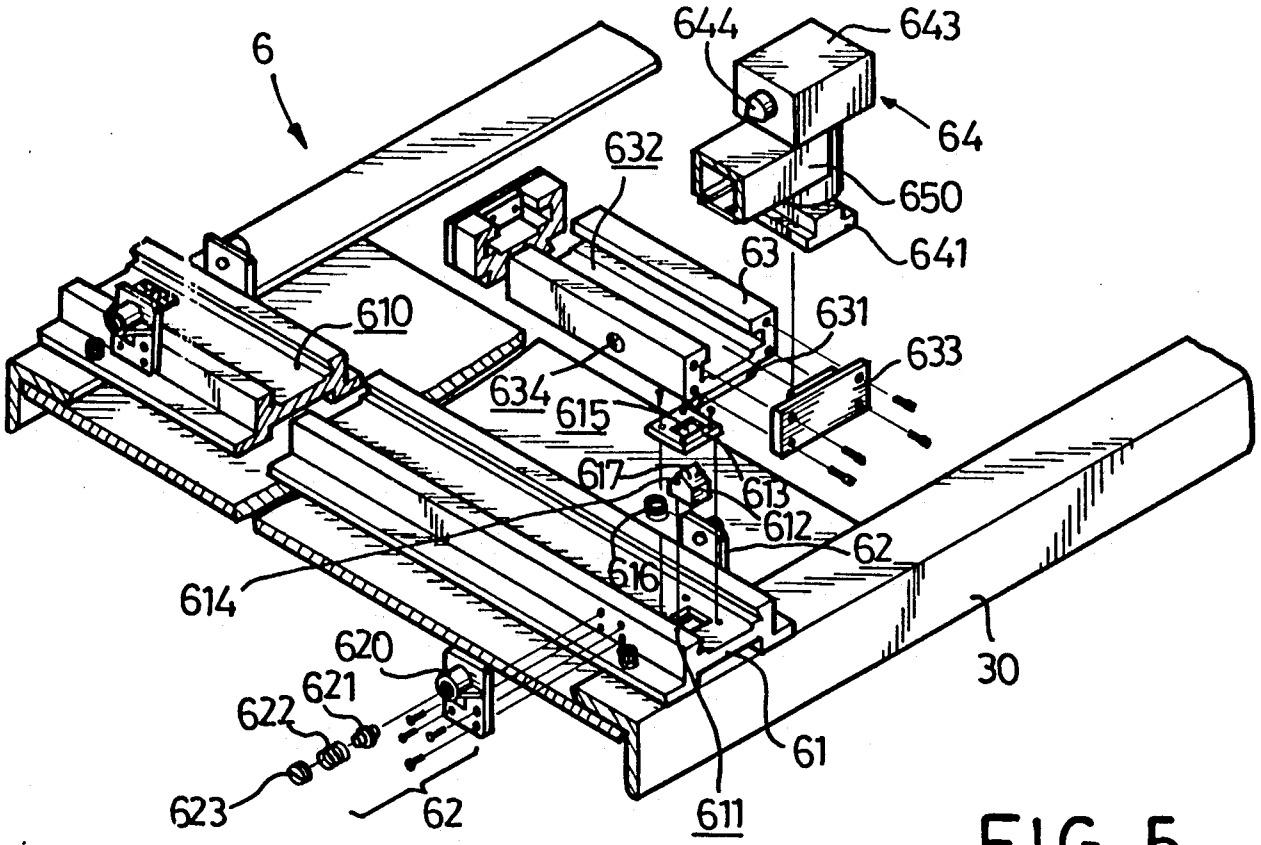
FIG. 5 is a partial exploded view of a cross slide feed mechanism which is disposed on the sliding conveyer.
Figure 6:
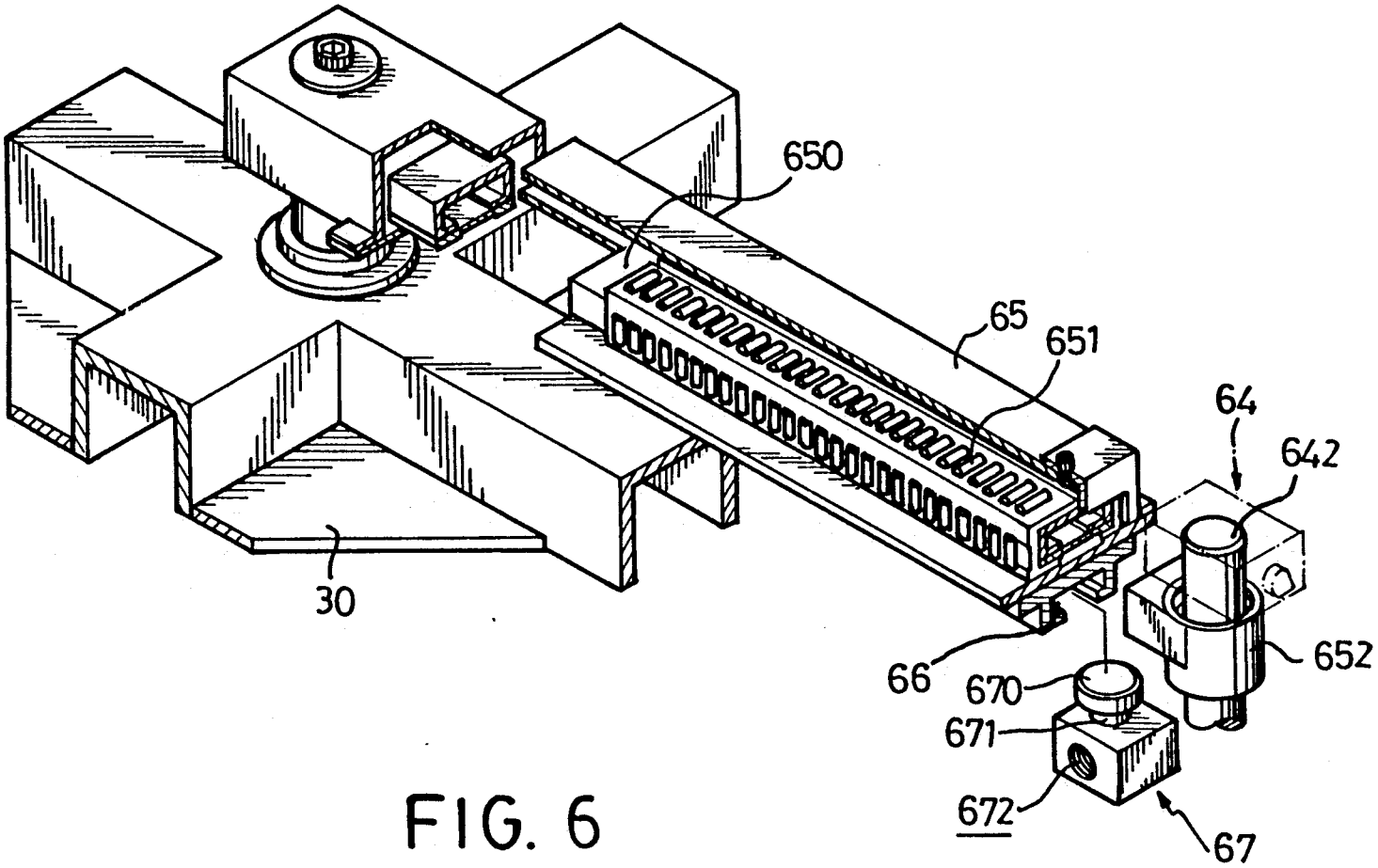
FIG. 6 is a partial perspective view of the cross slide feed mechanism.
Figure 7:
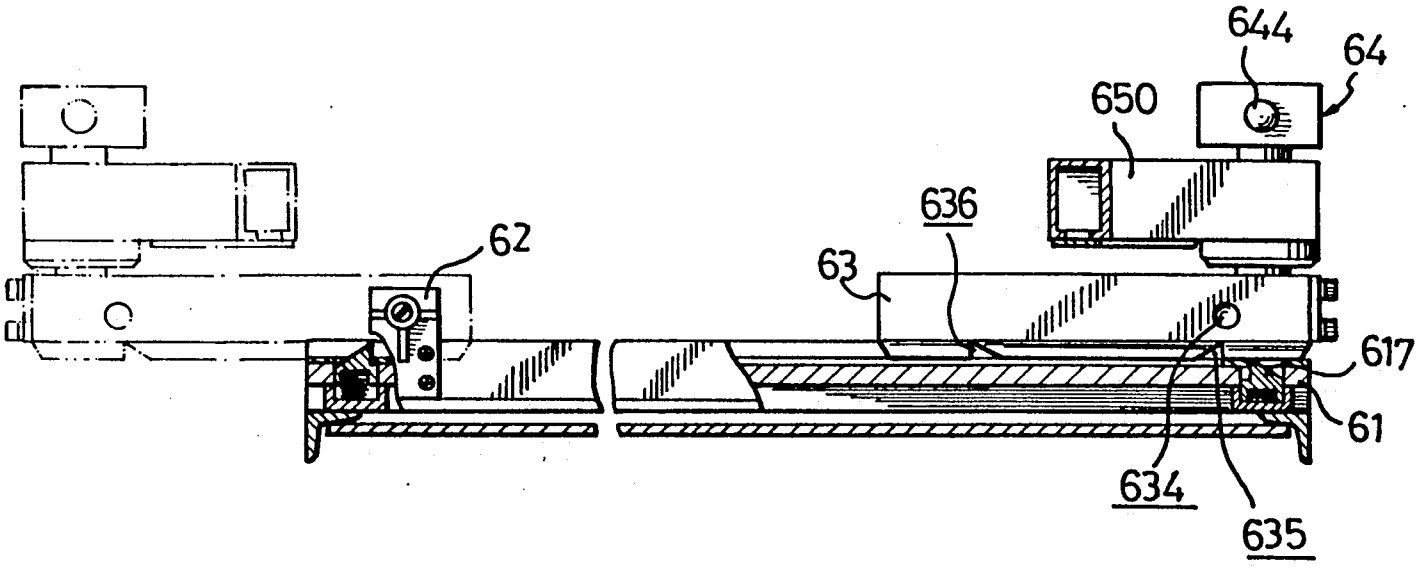
FIG. 7 is a partial cross-sectional view illustrating the limit of the movement of the cross slide feed mechanism.

Referring again to FIG. 4 and to FIGS. 5 to 7, a cross slide feed mechanism 6 is disposed on the upper frame 30. The cross slide feed mechanism 6 comprises generally a central track 61 laterally disposed on the middle portion of the upper frame 30, a sliding block 63 slidable along the central track 61, a catcher 64 slidable along the sliding block 63, a rocker arm 65 having an extendible inner tube 650 and a guide screw 68 controlling the rotation of the rocker arm 65. A first dovetail slot 610 is formed on the upper surface of the central track 61 along the length thereof. A hole 611 is formed at each end of the first dovetail slot 610. A wedged block 612 with a shoulder 614 is retained within each hole 611 by a cover plate 613. A spring element 616 is disposed below the wedged block 612. An opening 615 is formed on each cover plate 613 so that the wedge-shaped portion 617 of the wedged block 612 is urged to extend through the opening 615 of the cover plate 613 by the spring element 616. The inclined surface of each wedge-shaped portion 617 faces a respective end of the central track 61 (best shown in FIG. 7). The shoulder 614 prevents the wedged block 612 from leaving the hole 611. A pair of positioners 62 are disposed at each end of the central track 61 on both sides thereof. The positioners 62 are generally a plate with a short cylinder 620 provided on an upper end thereof. A protuberance 621 and a spring 622 are retained within the short cylinder 620 by a screw 623 so that the tip of the protuberance 621 resiliently protrudes out of an inner surface of the positioner 62 which faces the central track 61.

A first dovetail 631 is formed at a bottom of the sliding block 63 and a second dovetail slot 632 is formed upon the sliding block 63. A pair of end plates 633 close both ends of the second dovetail slot 632. The first dovetail 631 slides along the first dovetail slot 610 of the central track 61. A pair of holes 634, which are to be engaged with the protuberances 621 of the positioners 62, are formed at each end of the sliding block 63 on both sides thereof. As shown in FIG. 7, a pair of wedge-shaped recesses 635, 636 are formed on the bottom surface of the sliding block 63. When the sliding block 63 slides along the central track 61, the wedged block 612 is urged downward by the bottom surface of the sliding block 63 as shown in solid lines. When the sliding block 63 moves to the position as shown in image lines, the wedge-shaped portion 617 is urged up and engages within the wedge-shaped recess 635 so that the sliding block 63 is prevented from further movement. At this moment, the protuberances 621 are engaged with the respective holes 634 for positioning the sliding block 63. Therefore, part of the sliding block 63 may slide beyond the central track 61 without being separated.

A second dovetail 641 is formed on a bottom of the catcher 64 so as to slide along the second dovetail slot 632 of the sliding block 63. The catcher 64 comprises an axle 642 (FIG. 6) and a box 643 provided on a top thereof. A pair of catch pins 644 are controlled to be retracted into or protruded out of two opposite ends of the box 643 by means such as a hydraulic system, which can be easily achieved by present technology and will not be described in detail.

As shown in FIGS. 5 and 6, one end of the rocker arm 65 is pivoted on the upper frame 30. The inner tube 650 is slidably provided within the rocker arm 65. Four rows of rollers 651 are provided between the rocker arm 65 and the inner tube 650 for facilitating the sliding therebetween. A free end 652 of the inner tube 650 is pivoted on the axle 642 of the catcher 64. A channel 66, which is formed by a pair of substantially L-shaped elements, is provided on the bottom surface of the rocker arm 65. A head 670 with a reduced diameter portion 671 is formed on top of a coupling guide 67. The head 670 slides along the channel 66 of the rocker arm 65. A screw hole 672 is formed in the coupling guide 67 for threadedly engaging the guide screw 68 (FIG. 4). As shown in FIG. 4, the two ends of the guide screw 68 are pivotally supported on the upper frame 30 and the guide screw 68 is parallel to the central track 61. A driven gear 681 is provided on one end of the guide screw 68. A drive gear 691 is attached to one end of an axle of a motor 69 for engaging and driving the driven gear 681 of the guide screw 68. Therefore, the rocker arm 65 is actuated to swing by a threaded engagement between the coupling guide 67 and the guide screw 68 and by the motor 69.

Figure 12:
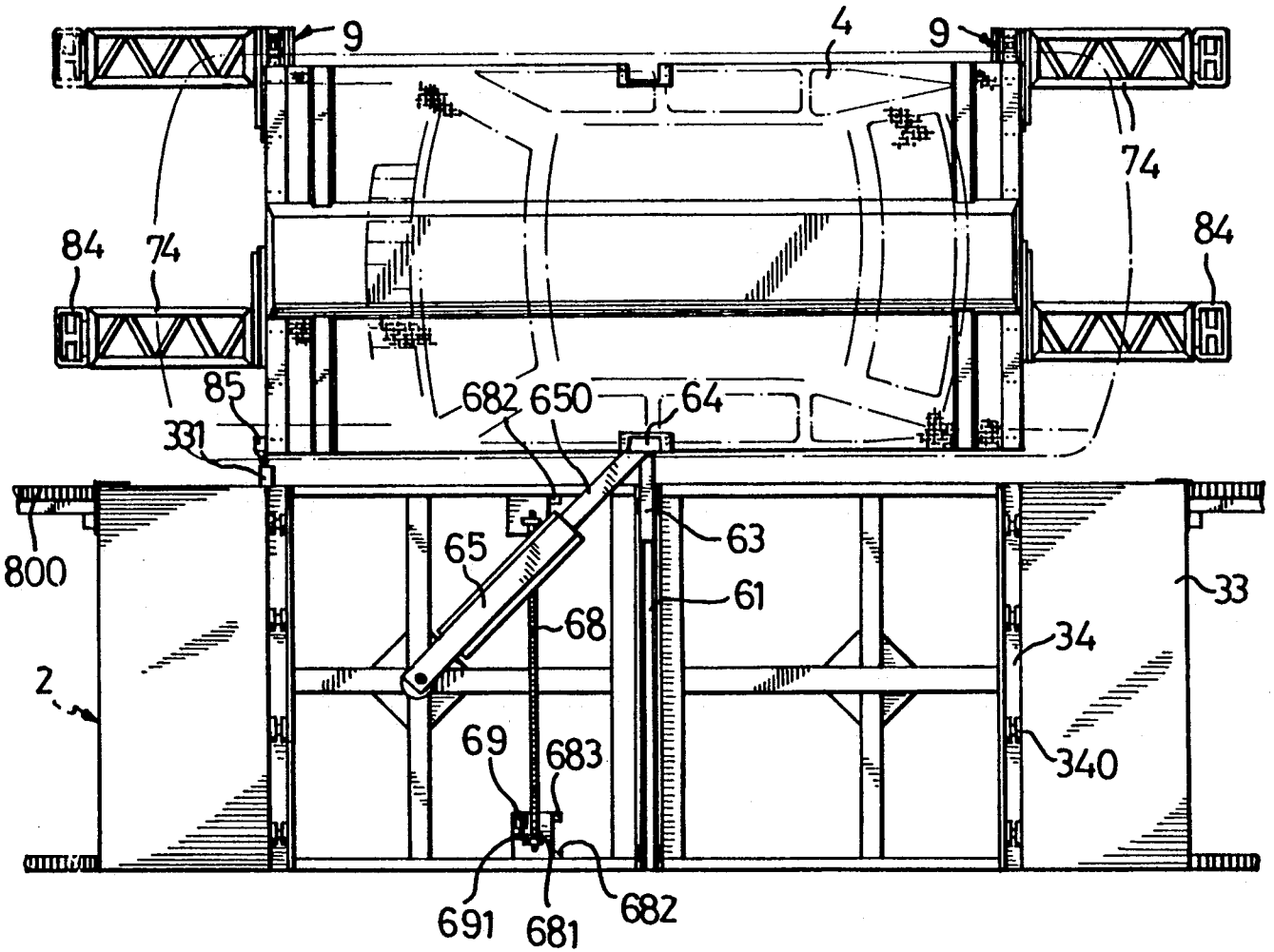
FIG. 12 is a top plan view illustrating the movement of the sliding conveyer and the sliding carrier.
Figure 13:
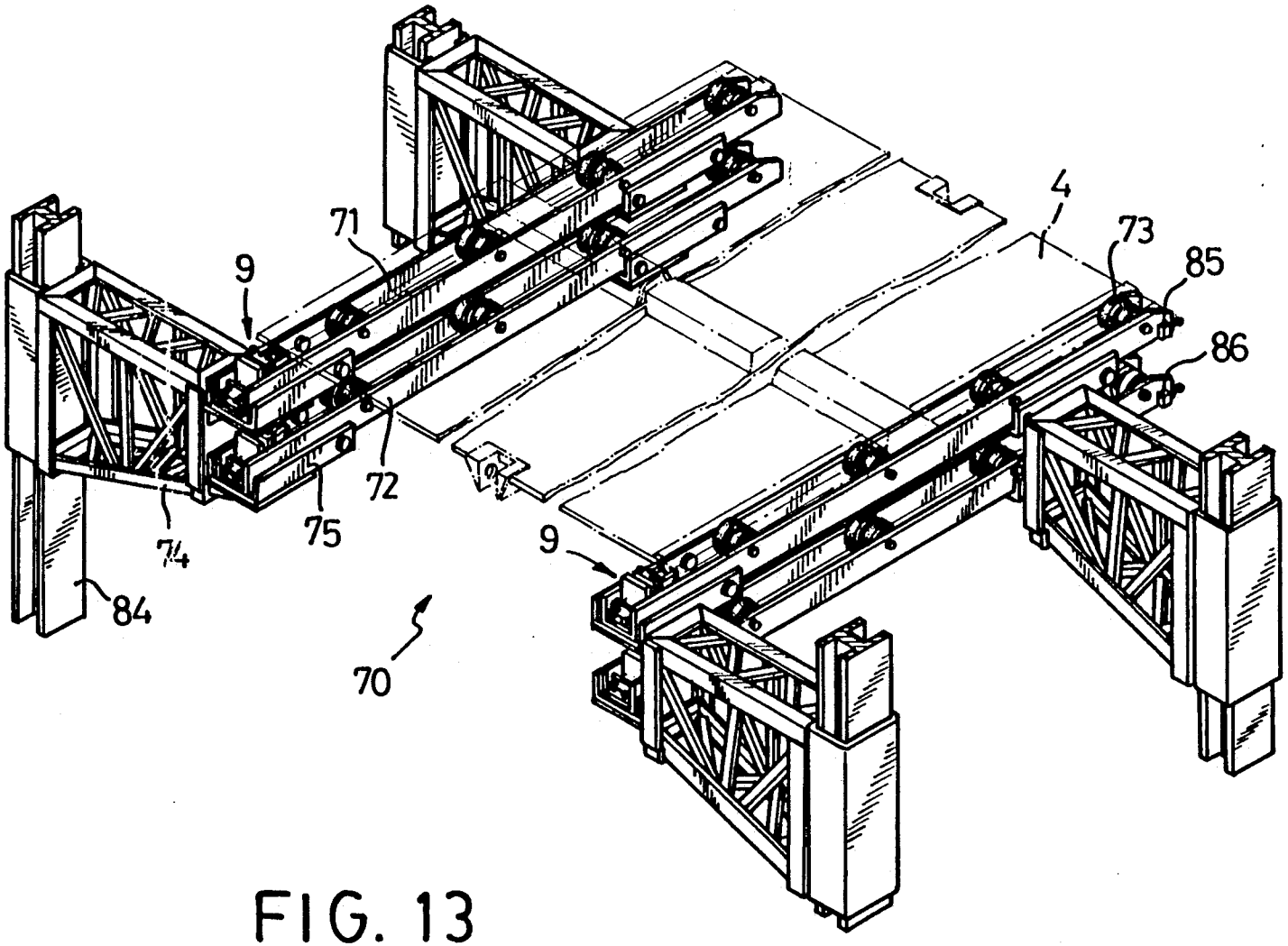
FIG. 13 is a partial perspective view of a holding unit for supporting a sliding carrier.
Figure 14:
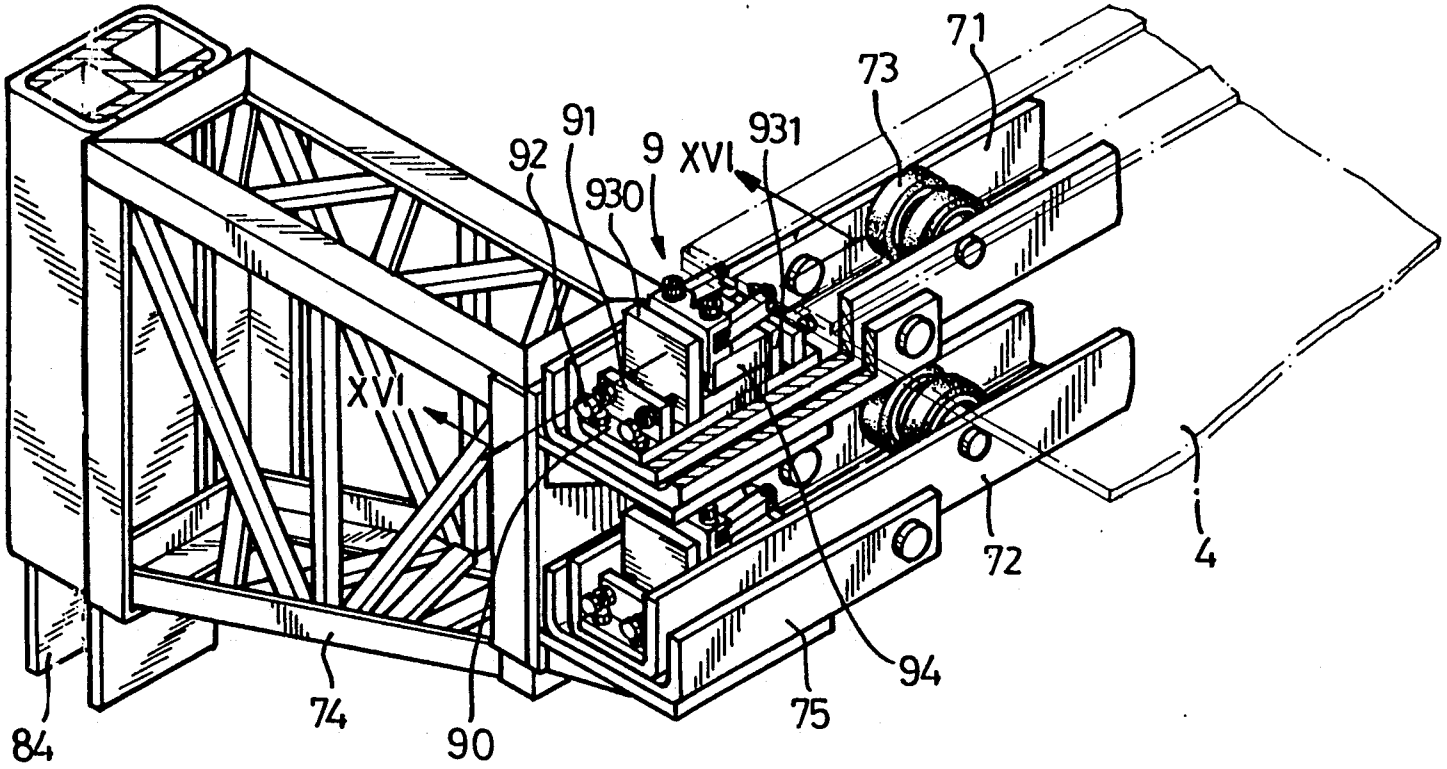
FIG. 14 is an enlarged partial perspective view of the holding unit.

As is best shown in FIG. 12, a pair of microswitches or sensors 682, 683 are provided on one side of each end of the guide screw 68, in which the outer microswitches 682 are located in an outer position relative to the inner microswitches 683, for sensing positions of the rocker arm 65. The microswitches 682, 683 are arranged in a manner such that the rocker arm 65 triggers the inner microswitch 683 when the catcher 64 is flush with a side surface of the sliding conveyer 2 (as shown by solid lines in FIG. 7), and triggers the outer microswitch 682 when the catcher 64 reaches an outermost position (as shown by image lines in FIG. 7).

Figure 8:
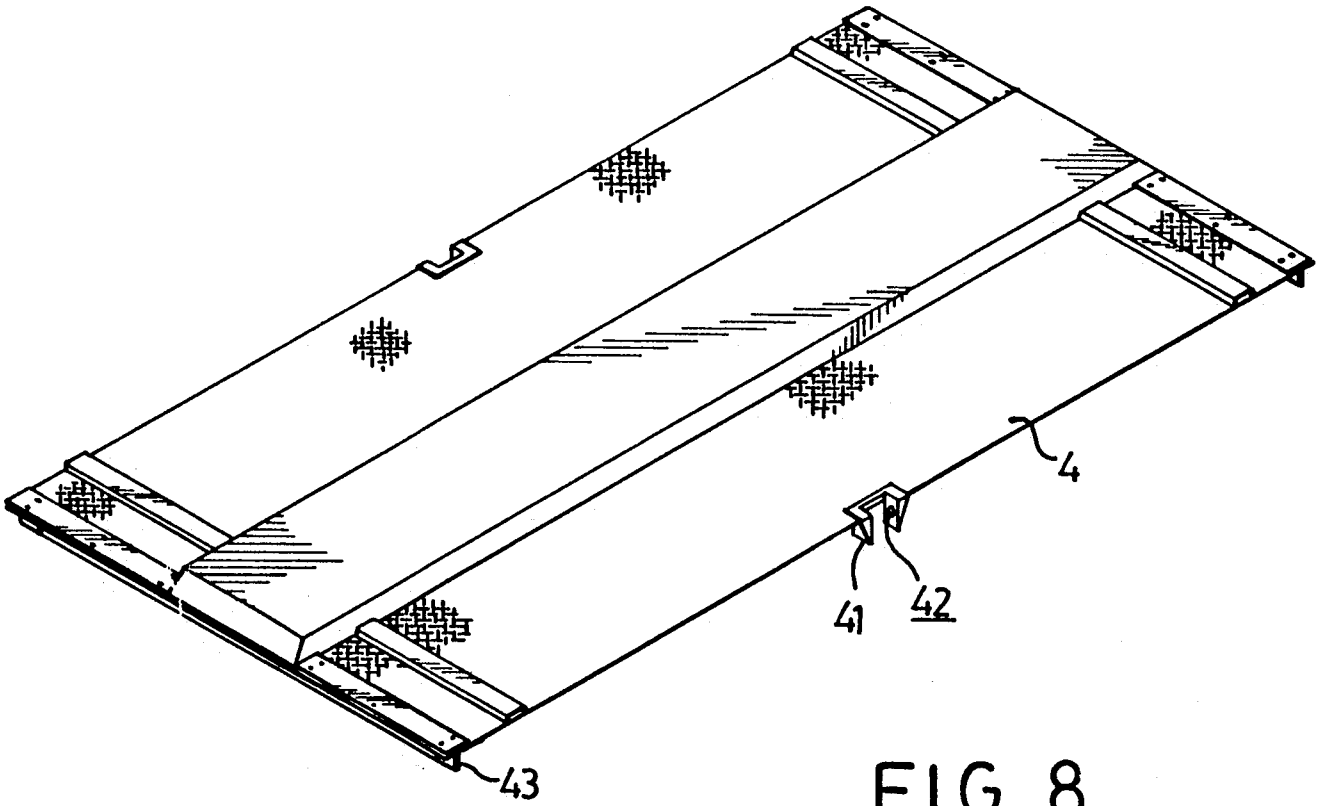
FIG. 8 is a perspective view of a sliding carrier.
Figure 9:
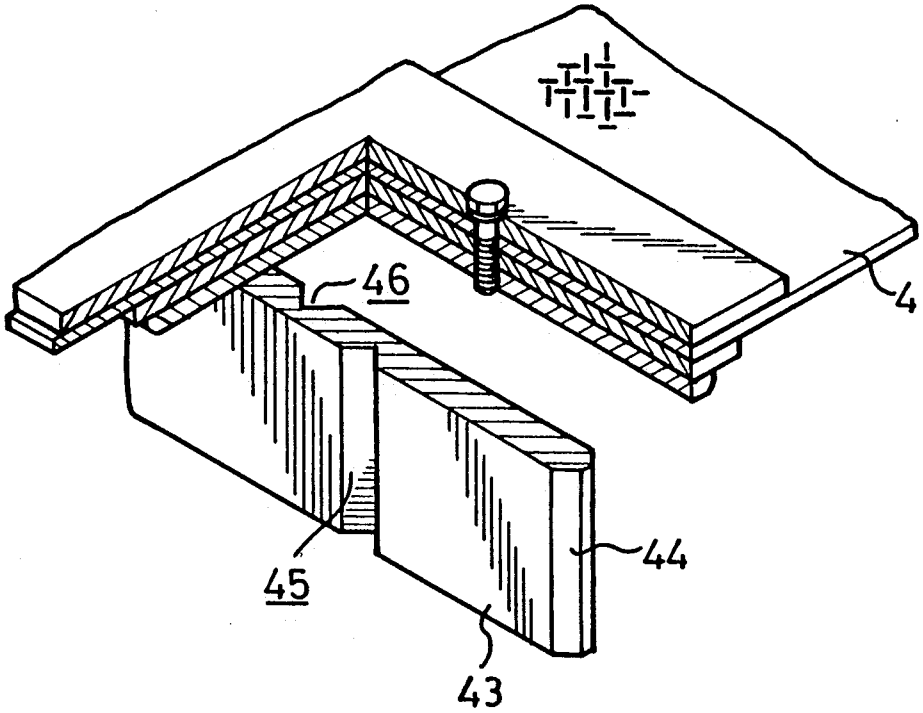
FIG. 9 is a partial cross-sectional view of the sliding carrier.

Referring next to FIGS. 8 and 9, the sliding carrier 4 is generally a plate with a guide slipper 43 provided at each end and on a bottom surface thereof. A pair of flanges 41, each with a hole 42, are provided at a middle portion of each lateral side of the sliding carrier 4. The box 643 of the catcher 64 (FIG. 5) is passable between the flanges 41, and the catch pins 644 are engageable with the holes 42 so that the sliding carrier 4 is carried to move laterally by the catcher 64. A wedged end or a tapered end 44 is formed at each end of each guide slipper 43. A pair of V-shaped notches 45, 46 are formed on each end portion of each guide slipper 43, in which the outer notch 45 is formed on an outer surface thereof and the inner notch 46 is formed on an inner surface thereof. The guide slippers 43 of the sliding carrier 4 are slidable along and between each pair of rollers 340 of the respective second track 34 (FIG. 4).

Figure 10:
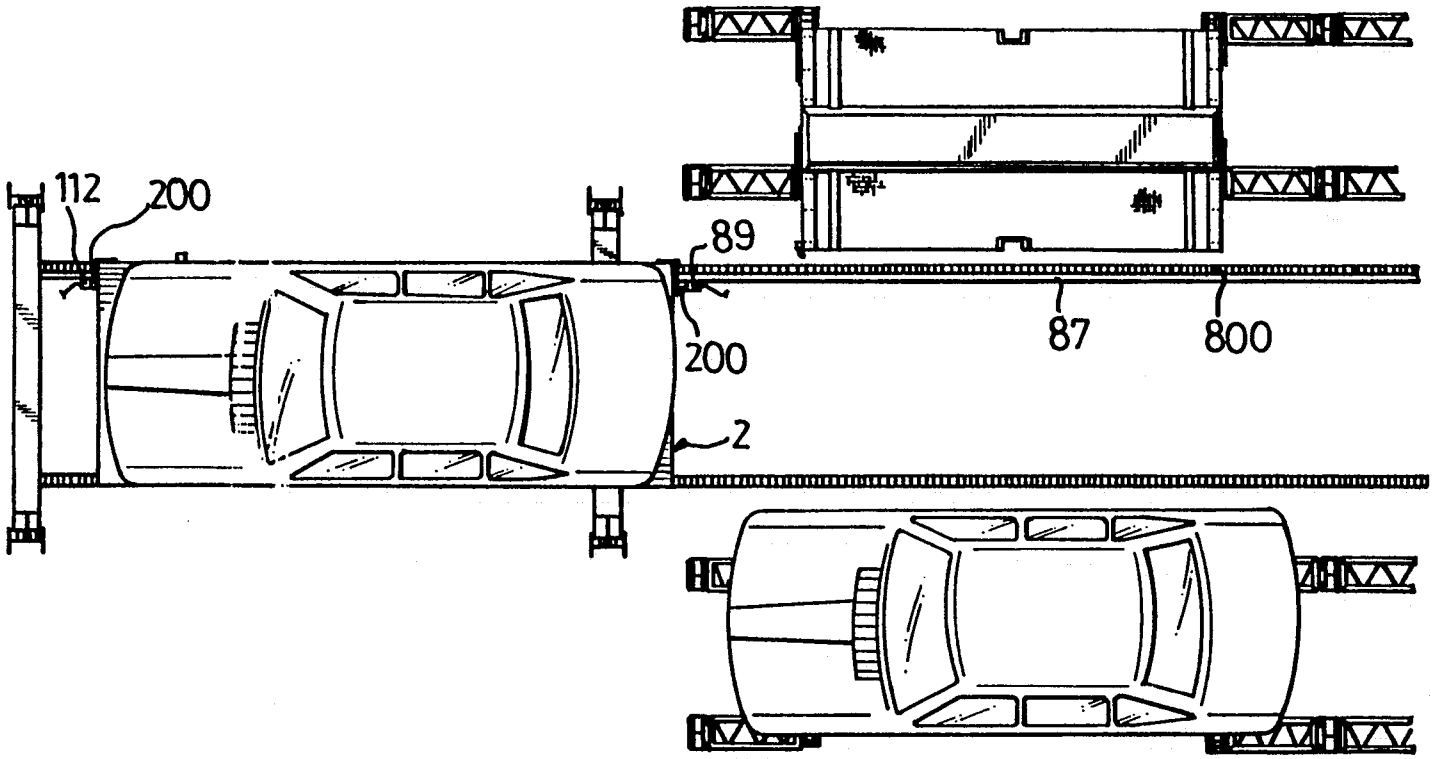
FIG. 10 is an enlarged top view of FIG. 1.
Figure 11:
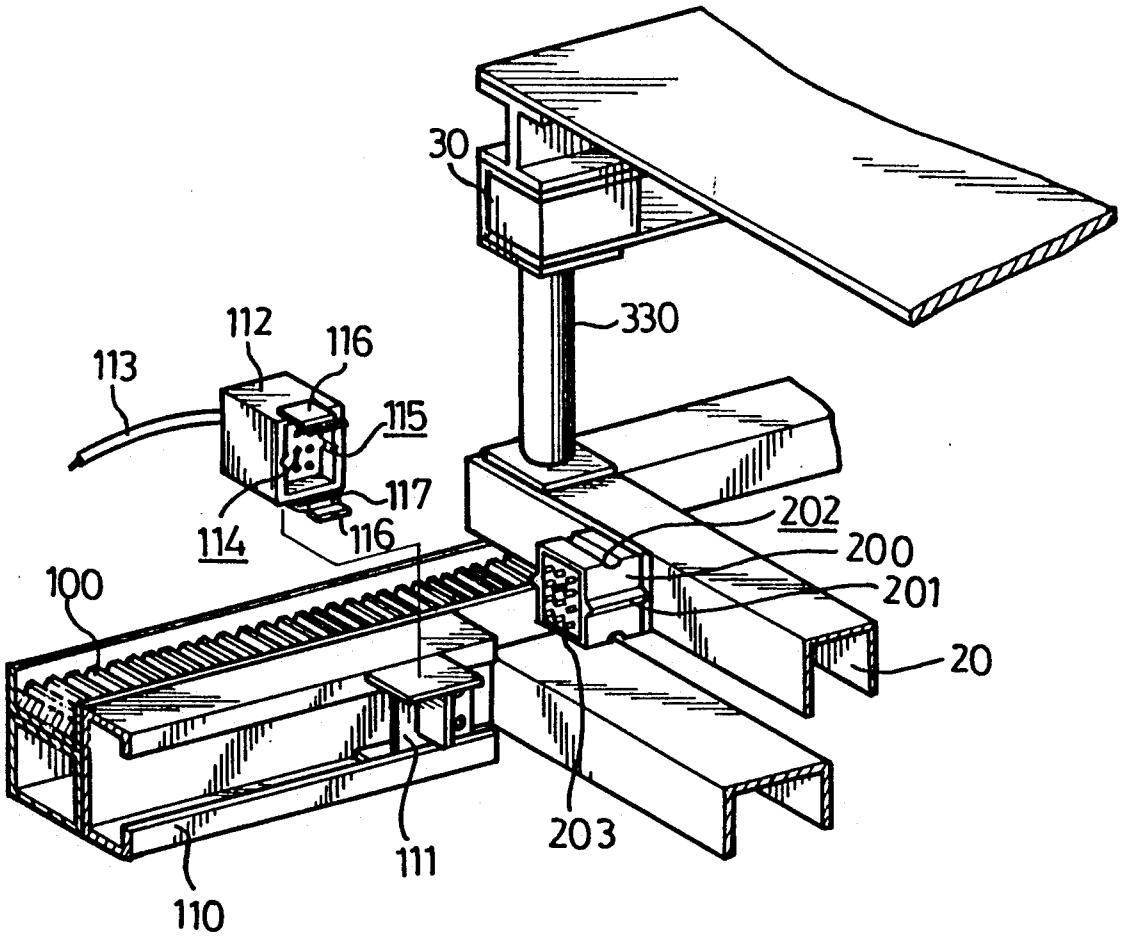
FIG. 11 is a partial perspective view illustrating a relative position between a socket and a plug.

Referring next to FIGS. 1, 10 and 11, a second guide channel 87 is provided beside one of the racks 800. The length of the second guide channel 87 is substantially equal to the length of the rack 800. A second socket 89 is fixed on a second sliding seat (not shown, similar to the first sliding seat 111), which is slidable along the second guide channel 87. An extension wire 890, which is connected to the computer, is connected to the second socket 89. As shown in FIG. 11, a rib 201 is formed on each side of the plug 200 and a lateral groove 202 is formed on an upper and a lower surface of the plug 200. A number of prongs 203 are provided on a front surface of the plug 200. A number of holes 114 are formed in an end surface of the first socket 112 for engagement with the prongs 203 of the respective plug 200. A notch 115 is formed in an inner surface of each side of the first socket 112. A pair of resilient plates 116, each with a flange 117, are provided on an upper and a lower surfaces of the first socket 112. The extension wire 113, which is connected to the computer, is connected to the first socket 112. The first socket 112 is arranged in such a manner that the plug 200 is capable of engagement with the first socket 112. The flanges 117 of the resilient plates 116 are engaged with the respective grooves 202 of the plug 200 and the ribs 201 are engaged with the notches 115. The configuration of the first socket 112 is similar to that of the second socket 89. As is best shown in FIG. 10, when the sliding conveyer 2 moves away from the elevator 1, the second socket 89 of the passage 800 engages with the respective plug 200 before the first socket 112 of the elevator 1 is separated from the respective plug 200; i.e., at least one plug 200 is engaged with the first and/or the second sockets 112, 89. On the contrary, when taking a car, the first socket 112 engages with the respective plug 200 before the second socket 89 is separated from the respective plug 200. The second socket 89 of each passage 800 is separated from the respective plug 200 of the sliding conveyer 2 when the sliding conveyer 2 fully slides into the elevator 1 so that the sliding conveyer 2 is freely to be moved up and down by the elevator 1.

Referring next to FIGS. 12 to 15, each holding unit 70 of the main frames 7 comprises four bracket frames 74, each being fixed on a vertically extending main beam 84, for supporting two parallel pairs of tracks 71, 72, in which the upper pair of tracks 71 are located higher than the lower pair of tracks 72. Four pairs of rollers 73 are pivoted and distributed along each pair of tracks 71, 72, which are substantially U-shaped, so that the sliding carrier 4 may slide along either the upper pair of tracks 71 or the lower pair of tracks 72. The vertical distance between the two pairs of tracks 71, 72 is large enough so that the sliding carrier 4 may slide along the lower pair of tracks 72 without being interfered with by the upper pair of tracks 71. A pair of microswitches or sensors 85, 86 are provided at the inner ends of one of the upper tracks 71 and of one of the lower tracks 72. A lug 331 or the like is provided on one side of the upper frame 30 of the sliding conveyer 2 so that the lug 331 triggers the respective microswitches 85, 86 when the sliding carrier 4 is aligned with the respective pair of tracks 71, 72.

Figure 15:
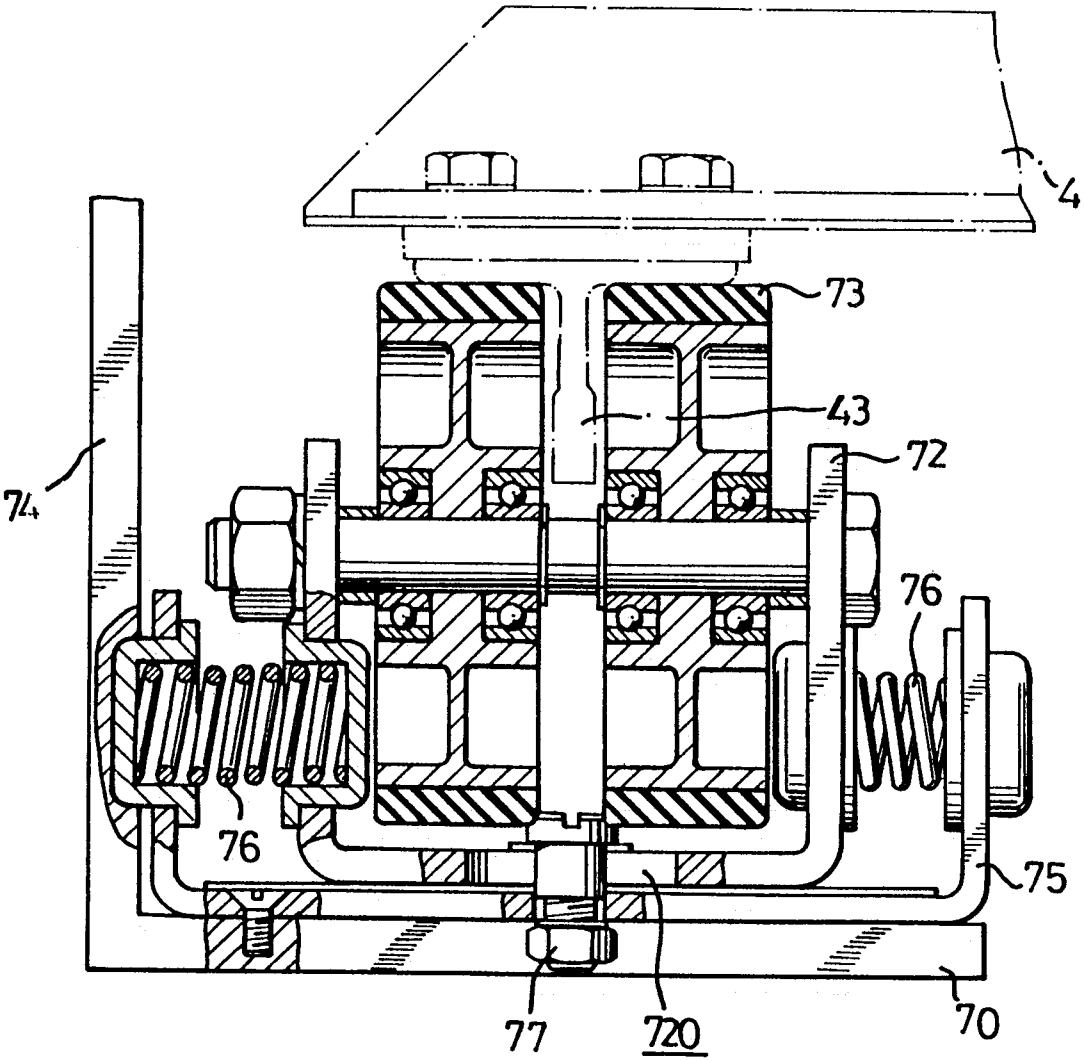
FIG. 15 is a partial cross-sectional view illustrating the rollers of the holding unit.

A U-shaped seat frame 75 is disposed below each end of each pair of tracks 71, 72. An oblong hole 720 is formed in a bottom of each end of each track of the pairs of tracks 71, 72. A bolt and nut 77 connects each track of the pairs of tracks 71, 72 and each seat frame 75 together. The oblong hole 720 is provided so that each track of the pairs of tracks 71, 72 may slide laterally relative to each seat frame 75. As best shown in FIG. 15, a spring element 76 is provided on each side of each seat frame 75 and bears between the seat frame 75 and the pair of tracks 71, 72 so that each pair of tracks 71, 72 may resiliently and laterally slide relative to each seat frame 75. The above-mentioned mechanism which is laterally movable is provided so that the guide slipper 43 of each sliding carrier 4 may slide easily into and between each pair of rollers 73 whether the guide slipper 43 is accurately aligned with the pairs of rollers 73 or not. The tapered ends 44 of the guide slippers 43 (FIG. 9) further facilitate the insertion of each guide slipper 43 into and between each respective pair of rollers 73.

Referring next to FIGS. 14 and 16 to 18, a retaining mechanism 9 is disposed in an outer end of each pair of tracks 71, 72. The retaining mechanism 9 includes a plate 90 with two lugs 91 being fixed on the respective pair of tracks 71, 72. A hole 910 is formed in each lug 91. An adjusting block 93 and a vertical plate 930 are rigidly connected together by bolts 931, and are slidably provided between the lugs 91. A third dovetail 932 is formed on the upper surface of the adjusting block 93. An adjusting bolt 92 passes through the hole 910 in each lug 91 and is threadedly fixed on each end of the adjusting block 93. The adjusting bolt 92 is freely slidable in the respective hole 910. An adjusting nut 920 is provided on the adjusting bolt 92 for adjusting the relative position between each lug 91 and the adjusting block 93. Therefore, the adjusting block 93 of each retaining mechanism 9 may be adjusted longitudinally relative to each pair of tracks 71, 72.

Figure 16:
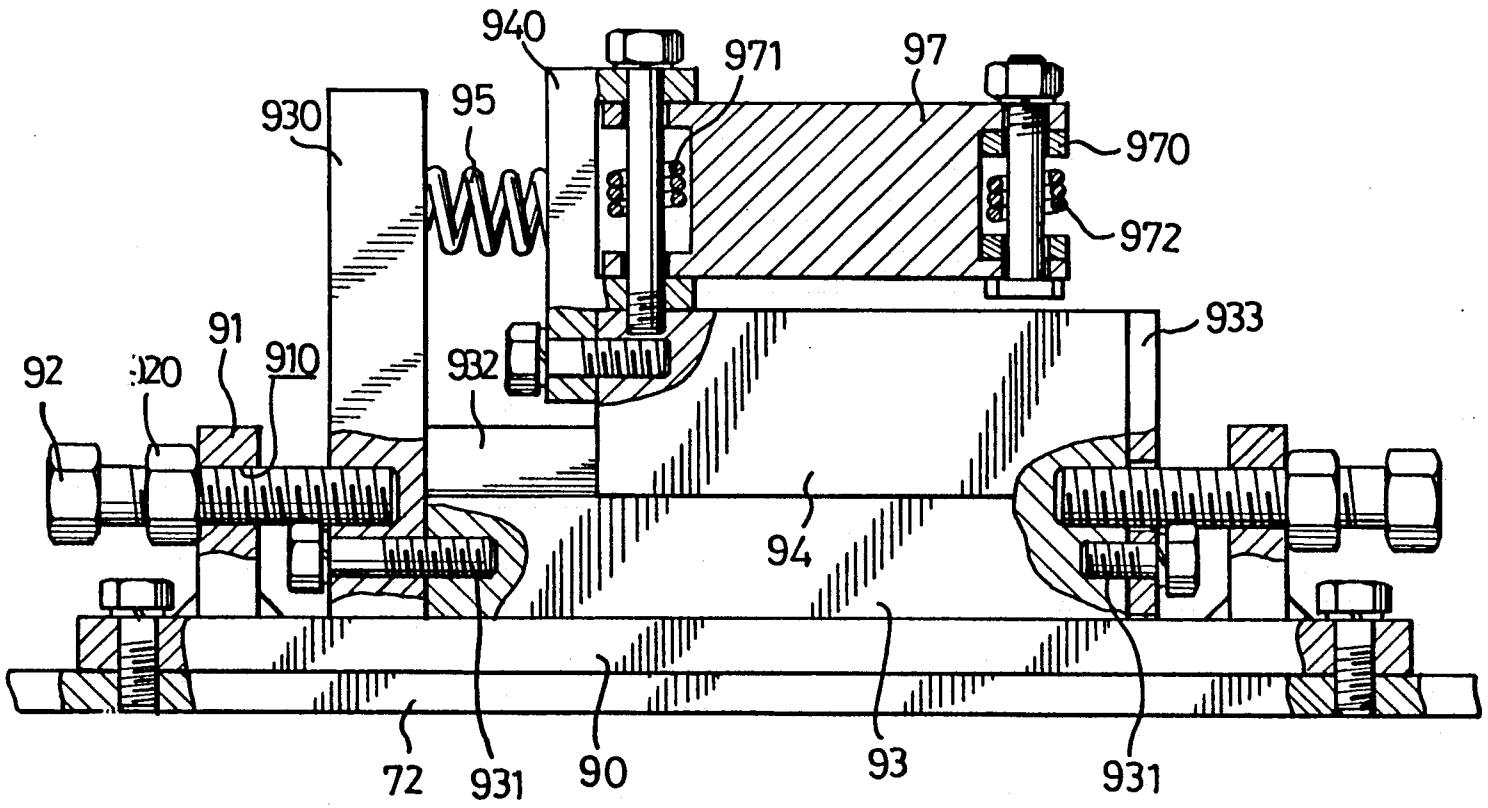
FIG. 16 is a partial cross-sectional view of the holding unit, taken along lines XVI—XVI of FIG. 14.

A third dovetail slot (not shown) is formed on the bottom surface of a sliding seat 94 so that the sliding seat 94 is slidable along the third dovetail 932 of the adjusting block 93. An end plate 940 is fixed on one side of the sliding seat 94. A stop plate 933 is fixed on an end of the adjusting block 93, opposite to the vertical plate 930, for limiting the sliding movement of the sliding seat 94. A spring element 95 bears between the end plate 940 and the vertical plate 930 so as to constantly urge the sliding seat 94 rightward as shown in FIG. 16.

A pair of longitudinal arms 96, 97 are pivoted on both ends of the end plate 940. A pair of coil springs 961, 971 are provided on the pivot axles of the respective longitudinal arms 96, 97. A pair of pawls 960, 970 are pivotally connected to the free ends of the respective longitudinal arms 96, 97. A pair of coil springs 962, 972 are provided on pivot axles of the respective pawls 960, 970. The tips of the pawls 960, 970 are substantially V-shaped corresponding to the V-shaped notches 45, 46 of the guide slippers 43 so that the tips of the pawls 960, 970 engage the respective notches 45, 46 when the respective guide slipper 43 of the sliding carrier 4 slides into the respective retaining mechanism 9.

Figure 17:
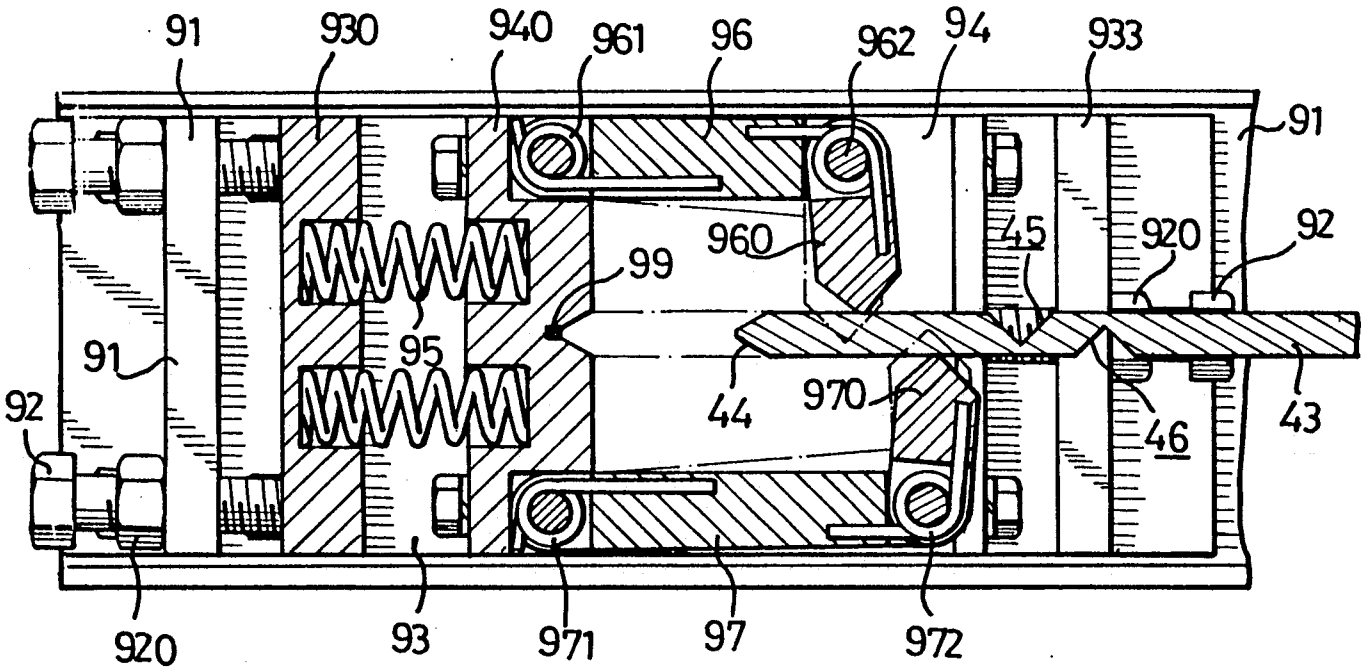
FIG. 17 is a top plan view of FIG. 16.
Figure 18:
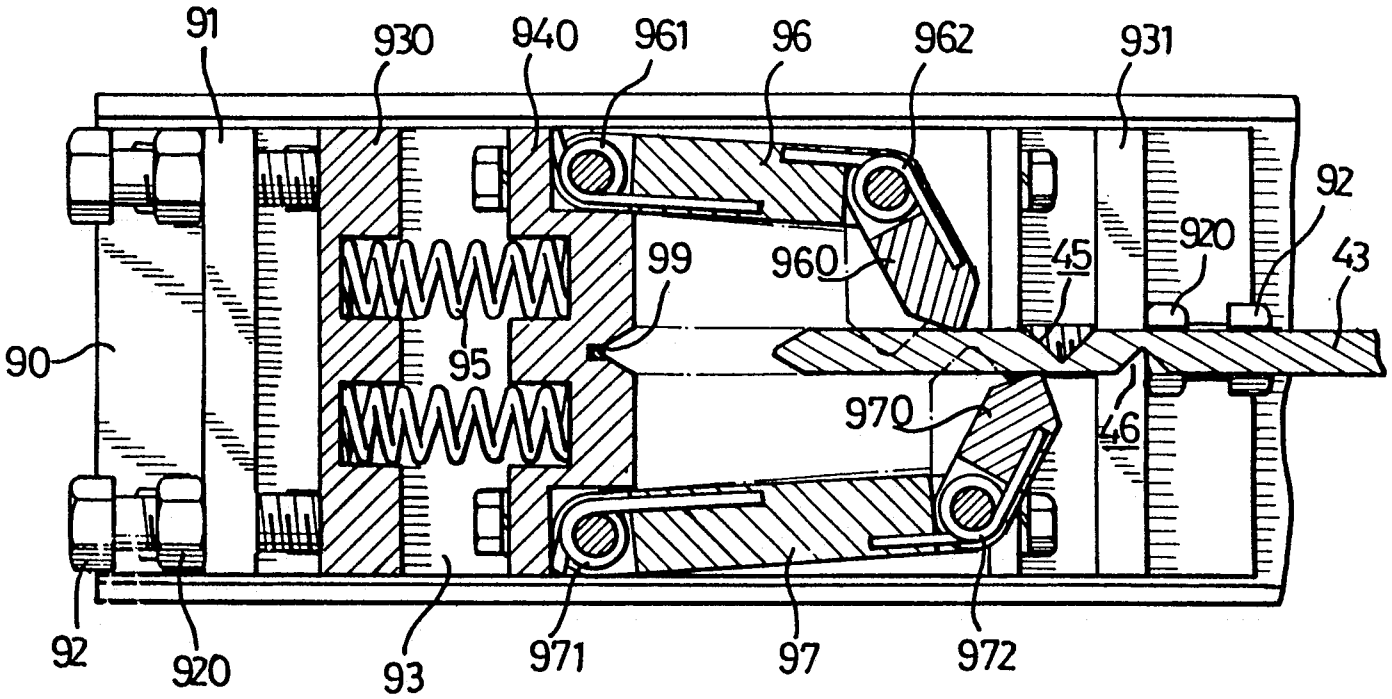
FIG. 18 is a top plan view similar to FIG. 17.

As shown in FIG. 17, the guide slipper 43 slides leftward into the retaining mechanism 9 so that the pawls 960, 970 are pushed leftward and the longitudinal arms 96, 97 are urged outward. When the guide slippers 43 of the sliding carrier 4 fully slide into the retaining mechanisms 9 and hit the end plates 940, the spring elements 95 damp the impact forces caused by the guide slippers 43 of the sliding carrier 4 and prevent the main frames 7 from being directly hit by the sliding carrier 4. The tips of the pawls 960, 970 are engaged with the notches 45, 46 and hold the respective guide slipper 43. As shown in FIG. 18, the guide slippers 43 of the sliding carrier 4 are pulled away from the respective retaining mechanisms 9. The pawls 95, 96 are pulled rightward so that the tips thereof are separated from the notches 45, 46 and so that the sliding carrier 4 may be pulled away from the retaining mechanisms 9. A microswitch or sensor 99 is disposed in the end plate 940 of one of the retaining mechanisms 9 of each pair of tracks 71, 72. The microswitch 99 is triggered when the guide slipper 43 of the sliding carrier 4 reaches and is engaged in the respective retaining mechanism 9.

Figure 19:
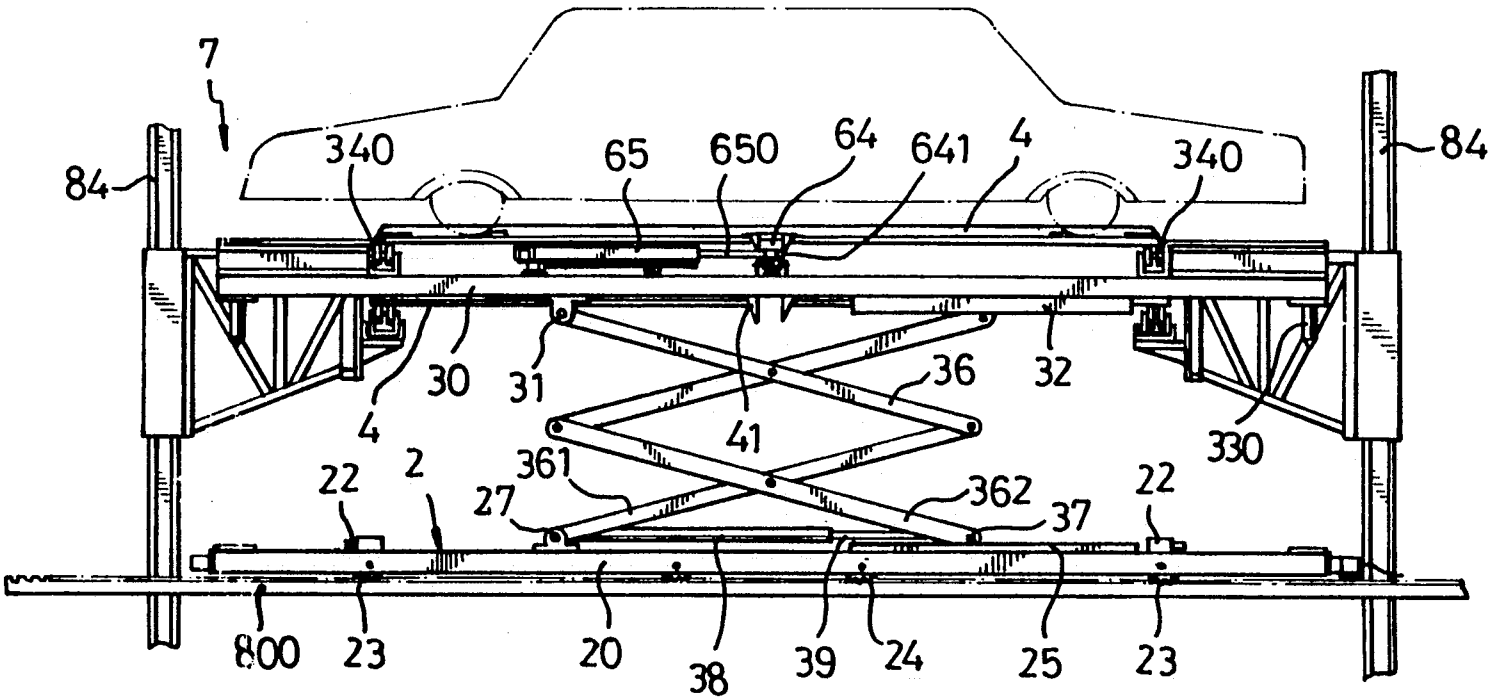
FIG. 19 is a side view illustrating a movement of the sliding conveyer.

Now, referring to FIGS. 1, 12, 13 and 19, when a vehicle which is carried on the sliding carrier 4, which is carried on the sliding conveyer 2, is to be parked in the parking lot in accordance with the present invention, the elevator 1 is elevated to align with one layer of the main frame 7 which has empty parking spaces. It is to be noted that one and only one pair of the tracks 71, 72 of every holding unit 70 hold a sliding carrier 4. When carrying no vehicle, the sliding carrier 4 is held on the lower pair of tracks 72. When carrying a vehicle, the sliding carrier 4 is held on the upper pair of tracks 71. The sliding conveyer 2 slides away from the elevator 1 and slides along the passage 80 of this layer until an empty sliding carrier 4 is found. At this moment, the catcher 64 engages and catches the flanges 41 of the sliding carrier 4. As shown in FIG. 19, the pistons 39 of the actuators 38 of the lifting mechanism 35 are retracted so that the rods 36 are extended until the sliding carrier 4 is aligned with the upper pair of tracks 71. Then, the guide screw 68 is driven by the motor 69 in order to swing the rocker arm 65. The sliding carrier 4 is actuated to move to the upper pair of tracks 71 by the rocker arm 65 until the guide slippers 43 of the sliding carrier 4 are engaged in the retaining mechanisms 9. The catch pins 644 of the catcher 64 are retracted into the box 643 and the rocker arm 65 is actuated to retract the catcher 64 to be separated from the sliding carrier 4. Then, the actuators 38 are actuated to lower the upper frame 30 until the upper frame 30 is aligned with the lower pair of tracks 72. The catch pins 644 of the catcher 64 are actuated to engage the holes 42 of the flanges 41 of the sliding carrier 4, which is carrying no vehicle, so that the sliding carrier 4 is pulled to the top of the upper frame 30 of the sliding conveyer 2. Then, the sliding conveyer 2 slides back to the elevator 1 and the elevator 1 is lowered to the ground for another parking service.

On the contrary, when a driver wishes to take his car, first, the sliding conveyer 2 with an empty sliding carrier 4 is elevated to the layer of main frames 7, which supports his car, by the elevator 1. Then, the sliding conveyer 2 slides along the passage 80 to a position beside the holding unit 70 which supports his car. The sliding carrier 4 is elevated to align with the lower pair of tracks 72 by the actuators 38 and to be pushed into and held by the lower pair of tracks 72. The catcher 64 is retracted and the upper frame 30 is elevated to align with the sliding carrier 4, which holds his car, on the upper pair of tracks 71. The catcher 64 catches the flanges 41 of the sliding carrier 4 so that the sliding carrier 4 is pulled back to the sliding conveyer 2 by the rocker arm 65. It is preferable that the upper frame 30 is lowered until the tapered pins 330 thereof are engaged in the respective holes 28 of the lower frame 20 when the sliding carrier 4 carries a vehicle and when the sliding conveyer 2 is moving.

The signals generated from the microswitches 83, 682, 683, 85, 86, 99 are transferred to and processed in the computer as mentioned above. The signals from the microswitches 99 are transferred to the computer so that the computer is aware of which holding units are holding vehicles and which are not.

Figure 22:
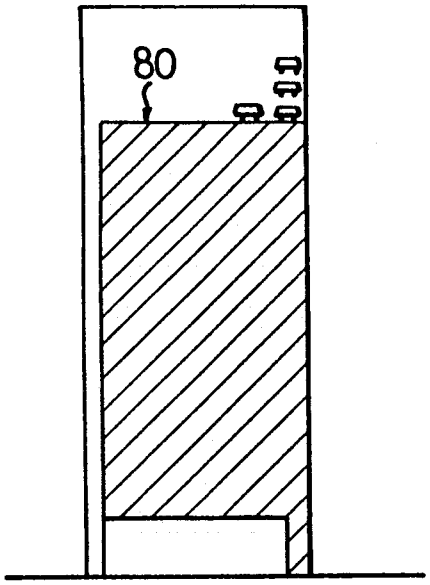
FIG. 22 is a schematic side view of a parking lot in accordance with one aspect of the present invention.

Alternatively, two or more layers of the holding units 70 are provided on each side of the passage 80 of each layer of the main frames 7. Accordingly, the lifting mechanism 35 of the sliding conveyer 2 is extendible for a height corresponding to the holding units 70. Therefore, two or more layers of holding units 70 require only one passage 80. As shown in FIG. 22, four layers of holding units 70 are provided on each side of each passage 80.

Figure 20:
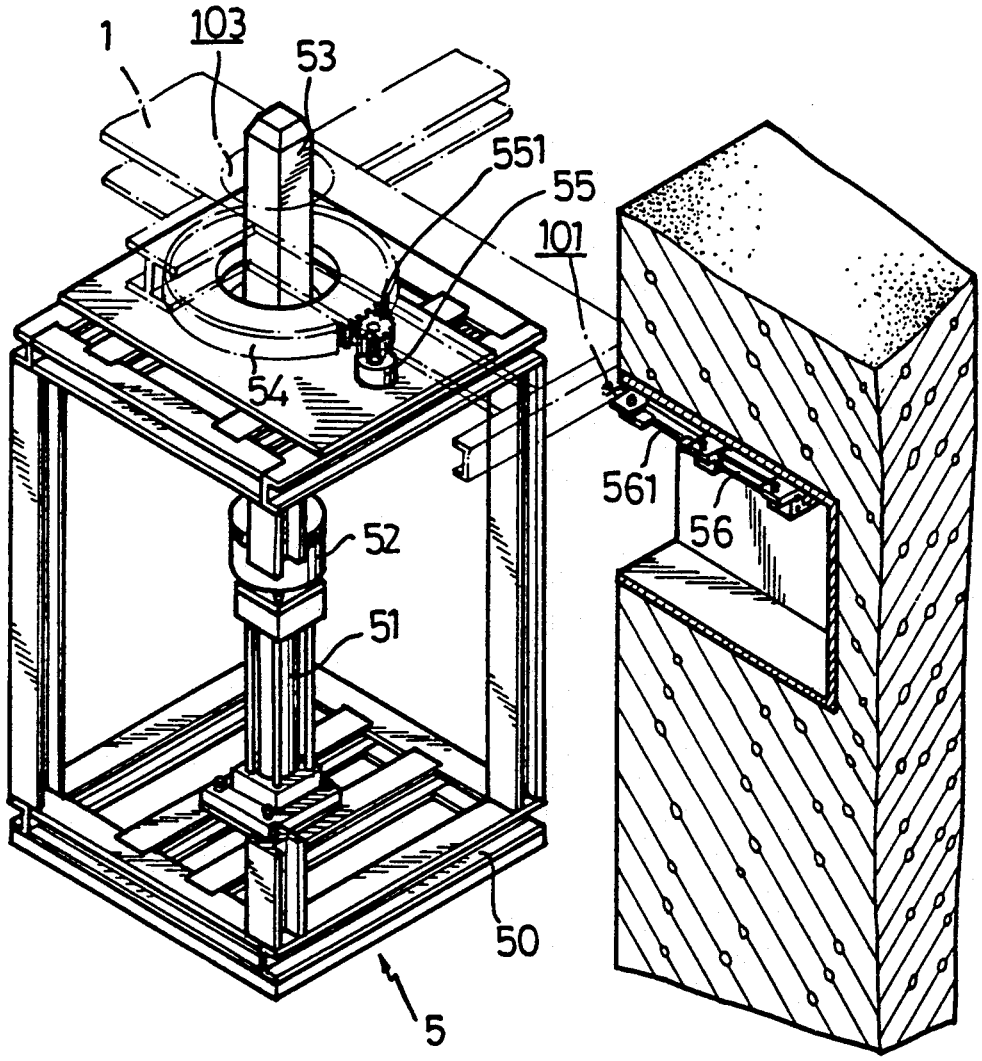
FIG. 20 is a partial perspective view of a rotating apparatus.
Figure 21:
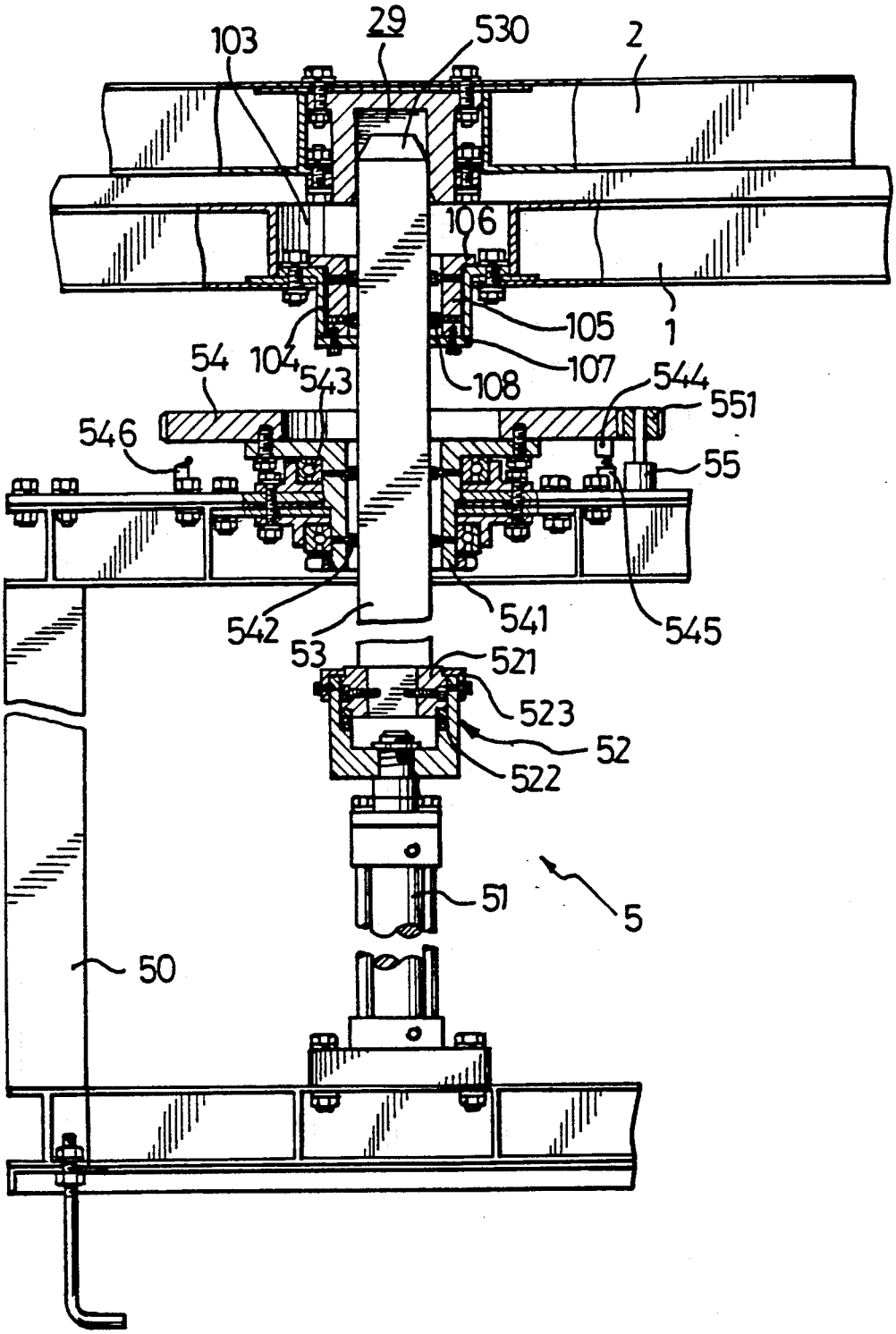
FIG. 21 is a partial cross-sectional view of the rotating apparatus.

FIGS. 20 and 21 illustrate a rotating mechanism 5 for rotating the sliding conveyer 2. The rotating mechanism 5 comprises generally a housing 50 which is disposed underground, an actuator 51 vertically disposed in the housing 50, a rotating shaft 53 being connected on top of the actuator 51 by a connector 52, a gear 54 fixed to the rotating shaft 53 and a motor 55 with a pinion 551 for engaging and driving the gear 54 and, in turn, for driving the rotating shaft 53 to rotate. The connector 52 is substantially cylindrically shaped with a lower end connected to an upper end of the actuator 51. A ring 521 is fixed at the lower end of the rotating shaft 53 and a bearing 522 is provided between the ring 521 and an inner surface of the connector 52. An annular cap 523 is fixed on top of the connector 52 in order to confine the ring 521 within the connector 52 so that the rotating shaft 53 is rotatable relative to the actuator 51. The gear 54 is disposed on a sleeve 541. A rectangular hole is formed in the sleeve 541 and two bolts 542 are threadedly fixed on each inner surface of the sleeve 541. The bolts 542 are arranged so that the rotating shaft 53 is extendible and slidable through the rectangular hole of the sleeve 541, and the rotating shaft 53 is rotatable with the sleeve 541. Two bearings 543 are provided between the sleeve 541 and the housing 50 so that the gear 54 and the rotating shaft 53 are freely rotatable relative to the housing 50. The pinion 551 which is attached on top of the motor 55 is engaged with the gear 54 so that the rotating shaft 53 is drivable by the motor 55.

Similarly, a short cylinder 104 is fixed on the lower side of the hole 103 of the elevator 1. A sleeve 105 with an annular flange 106 is provided within the short cylinder 104. An end plate 107 is fixed on the lower end of the sleeve 105 in order to confine the short cylinder 104 between the flange 106 and the end plate 107. A bearing or a lining (not shown) is provided between the sleeve 105 and the short cylinder 104 so that the sleeve 105 is freely rotatable about the short cylinder 104. A rectangular hole is formed in the sleeve 105. Two bolts 108 are disposed on each inner surface of the rectangular hole of the sleeve 105. The bolts 108 are arranged so that the sleeve 105 rotates with the rotating shaft 53, but the rotating shaft 53 is slidable in the rectangular hole of the sleeve 105; i.e., the elevator 1 is not rotated when the rotating shaft 53 is rotated. A rectangular hole 29, which opens downward, is formed in the center of the sliding conveyer 2. The upper end of the hole 29 is closed. It is preferable that the free end 530 of the rotating shaft 53 is tapered or frustum shaped so that the free end 530 is easily insertable into the rectangular hole 29 of the sliding conveyer 2. The sliding conveyer 2 is elevatable by the actuator 51 and rotatable by the motor 55 through the pinion 551 and the gear 54. Normally, a vehicle is directly driven onto the elevator 1 so that the vehicle is heading toward the inner side of the elevator 1. When a vehicle is taken back from the main frames 7, the vehicle is still heading toward the inner side of the elevator 1. The rotating mechanism 5 is provided to rotate the vehicle 180 degrees so that the vehicle heads outward and may be driven away directly without making a reversing movement.

A pair of microswitches or sensors 545, 546, which are located substantially 180 degrees apart, are disposed on the top surface of the housing 50. A lug 544 or the like is provided on a lower surface of the gear 54. The lug 544 is arranged so that the lug 544 triggers the respective microswitches 545, 546 when the lug 544 passes the respective microswitches 545, 546. The signals generated from the microswitches 545, 546 are transferred to and processed in the computer as mentioned above.

A pair of actuators 56 are provided, in the ground, on both sides of the elevator 1 corresponding to the holes 101 of the longitudinal beams 13 so that a pin 561 of each actuator 56 is extendible and engageable with the respective hole 101 of the elevator 1 when the elevator 1 is lowered to the ground level. Therefore, the elevator 1 is fixedly held by the actuators 56 when loading and unloading a vehicle.

Figure 23:
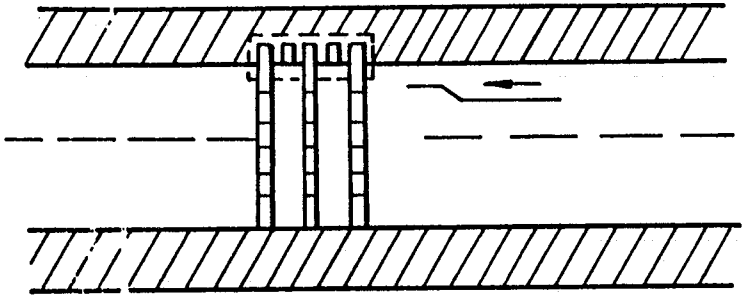
FIG. 23 is a top plan view of a parking lot in accordance with another aspect of the present invention.

As shown in FIG. 23, the elevator type parking lot in accordance with the present invention is suitable for being straddled over roads or even over cross roads, and occupies only a relatively small space of the road shoulder. They are suitable for construction in the down town area of busy cities. Only one elevator 1 is required for a row of parking lots, for example, three elevators 1 are required for the three rows of parking lots of FIG. 23.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An elevator type parking lot comprising:

a plurality of layers of main frames, each layer including a passage longitudinally provided on a center of a bottom surface thereof, at least one layer of holding units being provided along each side of said passage, each holding unit including a pair of upper tracks and a pair of lower tracks;

an elevator slidable vertically to align with each layer of said main frames;

a sliding conveyer being raised and carried by said elevator, said sliding conveyer being slidable on a bottom surface of said elevator and slidable along said passage of each layer of said main frames so as to align with each holding unit, said sliding conveyer including a lower frame and an upper frame connected together by a lifting mechanism, said lifting mechanism being extendible vertically so as to raise said upper frame, and a cross slide feed mechanism being provided upon said upper frame; and a sliding carrier being comprised of substantially a plate and being carried on said upper frame of said sliding conveyer, said sliding carrier being raised by said lifting mechanism to align with either said pair of upper tracks or said pair of lower tracks of each said holding unit, said sliding carrier being actuated to move laterally by said cross slide feed mechanism to either said pair of upper tracks or said pair of lower tracks, said sliding carrier being held on said pair of upper tracks of each said holding unit when carrying a motor vehicle and being held on said pair of lower tracks when carrying no vehicle.

2. An elevator type parking lot according to claim 1, wherein a rod is pivoted on each end of said lower frame of said sliding conveyer; a first motor is provided for actuating each said rod to rotate the same, a first gear is attached to each end of said rods; a first pair of racks are formed on a bottom surface of said elevator and a second pair of racks are formed on said passage of each layer of said main frames, said first racks are parallel to said second racks, said sliding conveyer is slidable along said passage by a sliding engagement among said first gears on said rods and said first pair of racks and said second pair of racks.

3. An elevator type parking lot according to claim 1, wherein said lifting mechanism includes a first shaft axially pivoted on said lower frame of said conveyer, a second shaft is parallel to said first shaft, said second shaft is slidable longitudinally along said lower frame, at least one actuator is connected between said first and said second shafts, and a plurality of bars are coupled together in a criss-crossed manner; a lower end of one lowest bar is pivotally connected to said first shaft, and a lower end of an other lower bar is pivotally connected to said second shaft; said lowest bars are extendible vertically by said actuators; and a first track is provided on each end of said second shaft so that said second shaft is slidable along said first tracks.

4. An elevator type parking lot according to claim 1, wherein said cross slide feed mechanism includes a central track laterally provided on said upper frame of said sliding conveyer, a sliding guide being slidable along said central track, a catcher being slidable along said sliding guide, a rocker arm being pivoted on said upper frame, an inner tube being provided in said rocker arm and extendible from a free end of said rocker arm, a free end of said inner tube being pivotally connected to said catcher, and a driving means for actuating said rocker arm to swing; said catcher is engageable with said sliding carrier so that said sliding carrier is actuated to move laterally by a swinging movement of said rocker arm and by said driving means.

5. An elevator type parking lot according to claim 4, wherein said driving means includes a coupling guide slidably provided on a bottom surface of said rocker arm, a screw hole formed on said coupling guide, a guide screw passing said screw hole of said coupling guide and being pivoted on said upper frame, said guide screw is substantially parallel to said central track, and a second motor is provided for rotating said guide screw so that said rocker arm is actuated to swing by a relative movement between said coupling guide and said guide screw.

6. An elevator type parking lot according to claim 1, wherein a guide slipper is disposed on each end of a lower surface of said sliding carrier; one row of first rollers are provided on each side of said upper frame; one row of second rollers are provided in each said pair of upper and said pair of lower tracks of said holding units of said main frames; said guide slippers are slidable along said first rollers of said upper frame and said second rollers of said holding units.

7. An elevator type parking lot according to claim 6, wherein each of said first roller and said second roller includes two sub-rollers rigidly connected together, said guide slipper of said sliding carrier is slidable between said sub-rollers of each of said first roller and said second roller.

8. An elevator type parking lot according to claim 6, wherein a retaining mechanism includes a pair of spring pawls pivoted on an outer end of each said pair of upper tracks and said pair of lower tracks of every holding unit; and a pair of notches are formed on each end of each said guide slipper; a tip of each said spring pawl is engageable with said respective notches of said guide slippers; said guide slippers of said sliding carrier are retained by said spring pawls of said respective retaining mechanisms when said sliding carrier is fully slided into each said holding unit.

9. An elevator type parking lot according to claim 8, wherein a sliding seat with an end plate is further provided on and is slidable relative to each said pair of upper tracks and said pair of lower tracks; an adjusting block with a vertical plate is further disposed below said sliding seat; and a second spring element is provided between said vertical plate and said end plate of said sliding seat; said adjusting block is slidable longitudinally relative to said pair of upper tracks and pair of lower tracks.

10. An elevator type parking lot according to claim 1, wherein a substantially U-shaped seat frame is laterally and slidably disposed beneath each end of said pair of upper tracks and said pair of lower tracks of every holding unit; and a pair of first spring elements are disposed in each said seat frame, each said first spring element bears between a side surface of said pair of tracks and an inner surface of said seat frame.

11. An elevator type parking lot according to claim 1, wherein a rotating mechanism is further provided directly below said elevator when said elevator is lowered to align with a first layer of said main frames; said rotating mechanism includes a housing, an actuator disposed vertically on a bottom surface of said housing, a rotating shaft vertically disposed on a top end of said actuator, and a rotating device provided on a top surface of said housing around said rotating shaft; said rotating shaft is extendible through said elevator and is engageable with a recess formed on a lower surface of said sliding carrier so that said sliding carrier and said rotating shaft are lifted by said actuator and are rotated by said rotating device.

12. An elevator type parking lot according to claim 11, wherein said rotating device includes a second gear disposed around a lower end of said rotating shaft, said second gear is rotatable about said casing, and a pinion is attached to one end of a third motor for engagement with said second gear; said rotating shaft is actuated to rotate by said third motor through said second gear and said pinion.

* * * * *